US009487364B2

(12) United States Patent
Kimura et al.

(10) Patent No.: US 9,487,364 B2
(45) Date of Patent: Nov. 8, 2016

(54) SHEET CONVEYING DEVICE AND IMAGE FORMING APPARATUS

(71) Applicants: Ippei Kimura, Osaka (JP); Mizuna Tanaka, Osaka (JP); Ikuo Fujii, Osaka (JP); Hirofumi Horita, Osaka (JP)

(72) Inventors: Ippei Kimura, Osaka (JP); Mizuna Tanaka, Osaka (JP); Ikuo Fujii, Osaka (JP); Hirofumi Horita, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/961,134

(22) Filed: Aug. 7, 2013

(65) Prior Publication Data

US 2014/0049000 A1 Feb. 20, 2014

(30) Foreign Application Priority Data

Aug. 17, 2012 (JP) ..... 2012-181180

(51) Int. Cl.

| | |
|---|---|
| ***B65H 3/52*** | (2006.01) |
| ***B65H 3/46*** | (2006.01) |
| ***B65H 3/66*** | (2006.01) |
| ***B65H 3/56*** | (2006.01) |

(52) U.S. Cl.

CPC ..... *B65H 3/46* (2013.01); *B65H 3/5223* (2013.01); *B65H 3/56* (2013.01); *B65H 3/66* (2013.01); *B65H 2301/51212* (2013.01); *B65H 2404/513* (2013.01); *B65H 2404/52* (2013.01)

(58) Field of Classification Search

CPC ..... B65H 3/5223; B65H 3/52; B65H 3/56; B65H 3/66; B65H 3/68

USPC ..... 271/121, 124

See application file for complete search history.

(56) References Cited

U.S. PATENT DOCUMENTS

| | | | | |
|---|---|---|---|---|
| 5,593,150 | A * | 1/1997 | Katayanagi et al. | 271/121 |
| 6,000,689 | A * | 12/1999 | Furuki et al. | 271/10.11 |
| 6,170,701 | B1 | 1/2001 | Youn | |
| 6,371,477 | B1 * | 4/2002 | Lin | B65H 3/5223 271/121 |

(Continued)

FOREIGN PATENT DOCUMENTS

| | | |
|---|---|---|
| CN | 1190060 A | 8/1998 |
| CN | 1273210 A | 11/2000 |

(Continued)

OTHER PUBLICATIONS

Office Action dated Jun. 1, 2016 in Japanese Patent Application No. 2012-181180.

Office Action dated Jun. 28, 2016 in Chinese Patent Application No. 2013-10358951.1.

*Primary Examiner* — Luis A Gonzalez

(74) *Attorney, Agent, or Firm* — Harness, Dickey & Pierce, P.L.C.

(57) ABSTRACT

A sheet conveying device includes a holder, a friction member, a rotary conveyance member having an outer circumferential surface and forming a nip area between the outer circumferential surface thereof and the friction member, the rotary conveyance member configured to rotate while contacting the friction member, and separate and convey multiple sheet-like materials one by one at the nip area, and a pair of guides configured to lift an underside of each of the sheet-like materials at a portion facing the friction member, the pair of guides disposed upstream from the nip area in a sheet conveying direction, outside both ends in an axial direction of the rotary conveyance member, separate from the nip area from the axial direction of the rotary conveyance member, and being overlaid with the outer circumferential surface of the rotary conveyance member.

22 Claims, 25 Drawing Sheets

(56) References Cited

U.S. PATENT DOCUMENTS

| | | | | |
|---|---|---|---|---|
| 7,731,177 | B2 * | 6/2010 | Ikeda | 271/121 |
| 2005/0285329 | A1 | 12/2005 | Ikeda | |
| 2009/0121418 | A1 | 5/2009 | Tanaka et al. | |
| 2009/0174135 | A1 | 7/2009 | Tanaka et al. | |
| 2009/0315250 | A1 | 12/2009 | Kimura et al. | |
| 2010/0019440 | A1 | 1/2010 | Fujiwara et al. | |
| 2010/0244367 | A1 | 9/2010 | Ikeda | |
| 2010/0314827 | A1 | 12/2010 | Nishii et al. | |
| 2011/0058829 | A1 | 3/2011 | Kondo et al. | |
| 2011/0058873 | A1 | 3/2011 | Honda et al. | |
| 2011/0115154 | A1 | 5/2011 | Fujiwara et al. | |
| 2011/0280626 | A1 | 11/2011 | Fukhima et al. | |
| 2012/0061907 | A1 | 3/2012 | Matsuyama et al. | |
| 2012/0063829 | A1 | 3/2012 | Matsuyama et al. | |
| 2012/0146281 | A1 | 6/2012 | Nishii et al. | |
| 2013/0043647 | A1 | 2/2013 | Fujii et al. | |
| 2013/0106050 | A1 | 5/2013 | Nishii et al. | |

FOREIGN PATENT DOCUMENTS

| | | | | |
|---|---|---|---|---|
| CN | 2450183 | Y | | 9/2001 |
| CN | 1317412 | A | | 10/2001 |
| CN | 1712342 | A | | 12/2005 |
| CN | 2009-67683 | Y | | 10/2007 |
| EP | 1577240 | A1 | | 9/2005 |
| EP | 1609748 | A1 | | 12/2005 |
| JP | 62222944 | A | * | 9/1987 |
| JP | H 02-178139 | A | | 7/1990 |
| JP | 07267419 | A | * | 10/1995 |
| JP | 2000-198560 | | | 7/2000 |
| JP | 2004-189350 | | | 7/2004 |
| JP | 2005-343582 | | | 12/2005 |
| JP | 2006-008330 | A | | 1/2006 |
| JP | 2008290809 | A | * | 12/2008 |
| JP | 2011162320 | A | * | 8/2011 |

* cited by examiner

SHEET CONVEYING DEVICE AND IMAGE FORMING APPARATUS

CROSS-REFERENCE TO RELATED APPLICATIONS

This patent application is based on and claims priority pursuant to 35 U.S.C. §119 to Japanese Patent Application No. 2012-181180, filed on Aug. 17, 2012 in the Japan Patent Office, the entire disclosure of which is hereby incorporated by reference herein.

BACKGROUND

1. Technical Field

Embodiments of the present invention relate to a sheet conveying device that conveys a sheet of recording material and an image forming apparatus including the sheet conveying device.

2. Related Art

Image forming apparatuses such as copiers such as digital copiers, printers such as laser printers, facsimile machines, and so forth include a sheet tray that accommodates a stack of sheets, so that the sheets are picked up and fed one by one to an image forming device. A sheet conveying device is used to feed the sheets one by one. This sheet conveying device includes a sheet separation/feeding mechanism employing a friction pad system, a FRR (friction reverse roller) system, or a corner separator system for separating and feeding a sheet of recording material.

A sheet conveying device employing the friction pad system includes a friction pad that functions as a friction member biased by a spring or other biasing member. The friction pad is pressed against an outer circumferential surface of a sheet conveying roller that functions as a rotary conveying member and is configured to prevent feeding of a sheet or sheets subsequent to an uppermost sheet picked from the sheet tray by the sheet conveying roller. Such a friction pad system is widely used because of its simple configuration that accepts various sheets having different widths.

Japanese Patent Application Publication No. JP 2005-343582-A discloses a sheet conveying device having a friction pad system. The sheet conveying device of JP 2005-343582-A includes a pair of projection members disposed laterally at both lateral end portions of a friction pad holder disposed downstream from a separation nip area formed between a sheet conveying roller and a friction pad. The pair of projection members lifts a sheet that has passed the separation nip area so as to avoid interference of the sheet with lateral end portions of a friction pad, preventing the sheet from having streaks and/or turnover thereon.

Japanese Patent Application Publication No. JP 2004-189350-A discloses another sheet conveying device having a friction pad system. In the sheet conveying device of JP 2004-189350-A, a center part of a friction pad to which a sheet conveying roller contacts is formed lower than both end parts of the friction pad to which sheet conveying roller does not contact, thereby forming a recess at the center portion and steps at the end parts (left and right). The steps cause the left and right parts of the sheet conveying roller to lift the sheet, which prevents the sheet from slidably contacting with both end parts of the friction pad and occurrence of abnormal sound.

Japanese Patent Application Publication No. JP 2000-198560-A discloses yet another sheet conveying device having a friction pad system. In the sheet conveying device of JP 2000-198560-A, a center part of a friction pad included therein is formed by a material smaller in hardness than both lateral sides thereof and the friction pad is cut at both lateral sides at a downstream part of a separation nip area so as to provide different resistances in sheet conveyance in the width direction of the sheet. By so doing, non-feeding of thick paper and multiple feeding of thin paper can be prevented.

SUMMARY

The present invention provides a sheet conveying device including a holder, a friction member held by the holder, a rotary conveyance member having an outer circumferential surface, forming a nip area between the outer circumferential surface thereof and the friction member, and configured to rotate while contacting the friction member, and separate and convey multiple sheet-like materials one by one at the nip area, and a pair of guides configured to lift an underside of each of the sheet-like materials at a portion facing the friction member, and disposed upstream from the nip area in a sheet conveying direction, outside both ends in an axial direction of the rotary conveyance member, separate from the nip area from the axial direction of the rotary conveyance member, and being substantially even with the outer circumferential surface of the rotary conveyance member.

Further, the present invention provides an image forming apparatus including the above-described sheet conveying device, an image forming device configured to form the image to be transferred onto the sheet fed by the sheet conveying device, a discharging tray configured to receive the sheet discharged, and a discharging device configured to discharge the sheet with the image formed thereon to an outside of the image forming apparatus.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
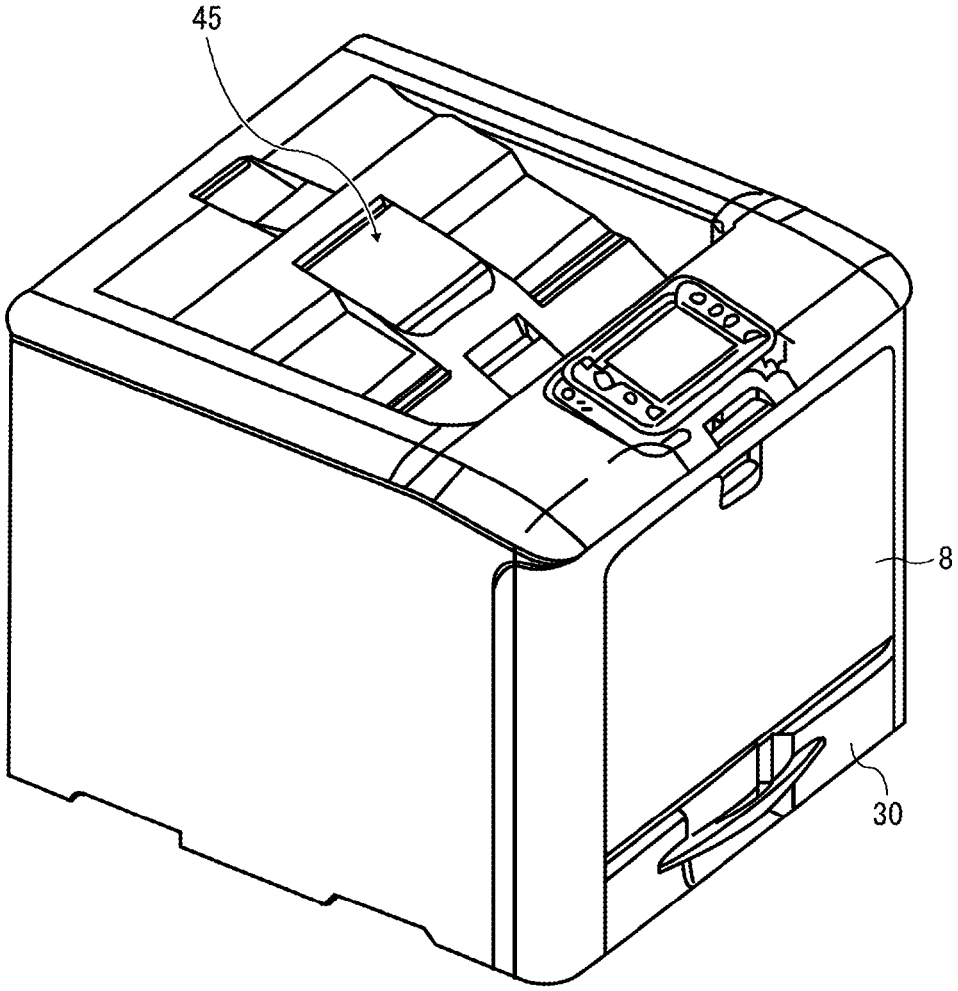
FIG. 1 is a perspective view illustrating an image forming apparatus including a sheet conveying device according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Descriptions are given of configuration and operations of an image forming apparatus 1000 according to an embodiment of the present invention.

Hereinafter, the image forming apparatus 1000 according to the present embodiment may be a copier, a facsimile machine, a printer, a multifunction printer having at least one of copying, printing, scanning, plotter, and facsimile functions, or the like. The image forming apparatus 1000 may form an image by an electrophotographic method, an inkjet method, and/or the like. According to an embodiment of the present invention, the image forming apparatus 1000 functions as a tandem-type color printer for forming a color image on a recording medium by the electrophotographic method. The image forming apparatus 1000 according to the present embodiment may also be applied to an image reader or a device or unit by which an image is not formed. Further, a sheet conveying device 40 (40A through 40G) as well as a sheet conveying device 95 are applicable to the image forming apparatus 1000.

Figure 2:
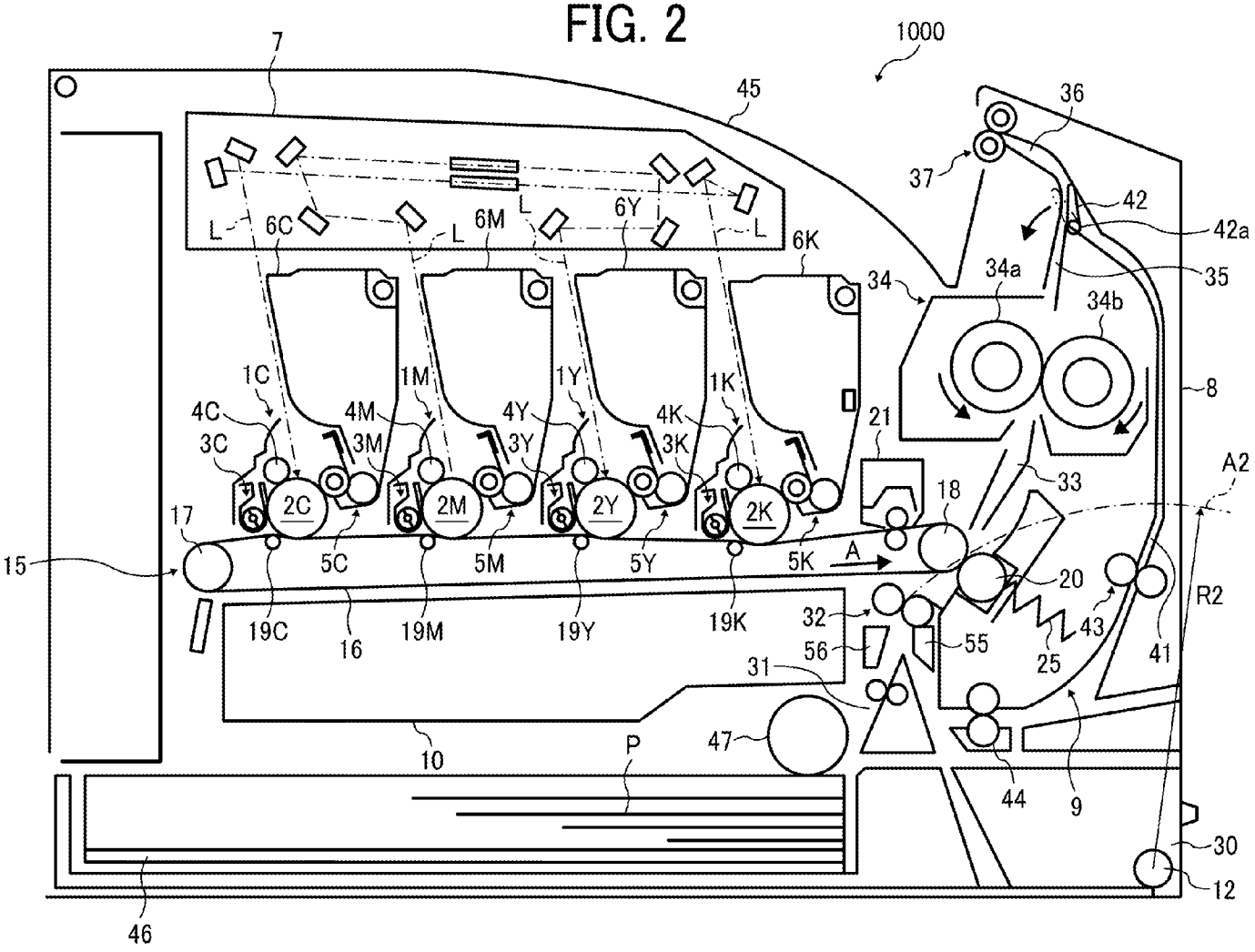
FIG. 2 is a cross-sectional view illustrating an internal structure of the image forming apparatus of FIG. 1.

A description regarding the image forming apparatus 1000 including a sheet conveying device 40 according to an embodiment is given with reference to FIGS. 1 and 2. A comparative example is described with FIGS. 3A through 3D. Detailed descriptions regarding the sheet conveying device 40 according to an embodiment are given with reference to FIGS. 4 through 20B, and a description regarding an image reader 90 including a sheet conveying device 95 according to an embodiment with reference to FIG. 21.

In the following embodiment(s), an "image forming apparatus" is defined as an apparatus that forms an image on a recording medium formed by a material such as paper, OHP sheet, thread, fabric, cloth, leather, metal, plastic, glass, wood, ceramics, and the like by attaching developer or ink.

Further, "image forming" or an "image forming operation" is defined as not only forming an image with specific meaning such as text and figure and transferring the image onto a recording medium but also an image without specific meaning such as pattern and transferring the image onto a recording medium.

Further, a "sheet-like material" is a recording medium including not only a sheet of paper but also OHP sheet, cloth, and the like, to which developer or ink is attached. The sheet-like material also includes target recording medium, recording medium, recording paper, recording sheet, and the like. In the following embodiment(s), such a sheet-like material is represented by a "paper" or a "sheet of recording medium".

Size, material, shape, and relative position of each unit and component are described as examples and are not limited thereto unless otherwise specified.

[Image Forming Apparatus]

FIGS. 1 and 2 show an example of the image forming apparatus 1000, specifically a tandem-type color laser printer with multiple image carriers aligned horizontally.

FIG. 1 is a perspective view of an appearance of the image forming apparatus 1000. As illustrated in FIG. 1, the image forming apparatus 1000 includes a sheet tray 30, a cover 8, and a sheet discharging tray 45.

The sheet tray 30 is disposed at a lower portion of the image forming apparatus 1000 to accommodate a paper stack including a paper P therein. The cover 8 is disposed above the sheet tray 30 to rotate about a rotary shaft 12 disposed at a lower portion thereof to open outwardly, so as to check an interior of the image forming apparatus 1000. The sheet discharging tray 45 functioning as a sheet discharging portion is disposed at an upper portion of the image forming apparatus 1000.

As illustrated in FIG. 2, four process units 1C, 1M, 1Y, and 1K are disposed in an interior of the image forming apparatus 1000. The four process units 1C, 1M, 1Y, and 1K function as image forming devices for C (cyan) images, M (magenta) images, Y (yellow) images, and K (black) images, respectively. The process units 1C, 1M, 1Y, and 1K have configurations identical to each other except for colors of toners.

Hereinafter, reference symbols "C" for cyan, "M" for magenta, "Y" for yellow, and "K" for black may be attached to each unit or component corresponding to the toner color. These reference symbols may be omitted occasionally.

The process units 1C, 1M, 1Y, and 1K include drum-shaped image carriers 2C, 2M, 2Y, and 2K, respectively. The four image carriers 2C, 2M, 2Y, and 2K are aligned horizontally at given intervals in the image forming apparatus 1000, as illustrated in FIG. 2. The image carriers 2C, 2M, 2Y, and 2K rotate clockwise due to a drive force transmitted by a non-illustrated drive source during operation of the image forming apparatus 1000.

Respective image forming units and components for forming an electrophotographic image are disposed around each image carrier 2 (i.e., the image carriers 2C, 2M, 2Y, and 2K). These units and components are a drum cleaning roller 3 (i.e., drum cleaning rollers 3C, 3M, 3Y, and 3K), a charging roller 4 (i.e., charging rollers 4C, 4M, 4Y, and 4K), a development roller 5 (i.e., development rollers 5C, 5M, 5Y, and 5K), and the like.

The charging roller 4 uniformly charges a surface of the image carrier 2.

The development roller 5 is included in a development device that contains developer or toner for developing a latent image formed on the surface of the image carrier 2 into a visible toner image.

The drum cleaning roller 3 removes residual toner remaining on the surface of the image carrier 2 after development to clean the surface of the image carrier 2.

An exposure device 7 is disposed above the image carriers 2C, 2M, 2Y, and 2K. The exposure device 7 that functions as a latent image forming device emits laser light beams L corresponding to image data of each color to scan respective charged surfaces of the image carriers 2C, 2M, 2Y, and 2K and form respective electrostatic latent images on the respective surfaces of the image carriers 2C, 2M, 2Y, and 2K.

Respective long and narrow slots extending in respective axes of rotational shafts of the image carriers 2C, 2M, 2Y, and 2K are provided between the charging rollers 4C, 4M, 4Y, and 4K and the image carriers 2C, 2M, 2Y, and 2K, so that laser light beams L emitted by the exposure device 7 can enter in the process units 1C, 1M, 1Y, and 1K toward the image carriers 2C, 2M, 2Y, and 2K.

The exposure device 7 illustrated in FIG. 1 is a laser scanning type exposure device that uses a laser light source, a polygon mirror, and the like and emits the laser light beams L from non-illustrated four semiconductor lasers. The laser light beams are modulated according to corresponding image data to be formed. The exposure device 7 accommodates optical parts and parts for control circuit use in a resin or metallic housing and includes a permeable duct protector at an exit formed on a top surface thereof. The expose device 7 illustrated in FIG. 2 includes one housing but is not limited thereto. For example, the image forming apparatus 1000 can include multiple exposure devices corresponding to the image forming devices (i.e., the process units 1C, 1M, 1Y, and 1K in the present embodiment). Alternative to the exposure device 7 that emits the laser light beams L, the image forming apparatus 1000 can employ an exposure device that is a combination of a known LED array and an image forming unit.

The image forming apparatus 1000 further includes four toner bottles 6C, 6M, 6Y, and 6K that contain respective color toners. Consumption amount of each color toner is detected by a non-illustrated toner amount detector. When the toner amount detector detects a given consumption amount of color toner, the color toner is supplied from a corresponding one of the toner bottles 6C, 6M, 6Y, and 6K to the corresponding development device via a non-illustrated toner supplier.

The development roller 5 includes a stainless or aluminum cylindrical member that is rotatably supported to maintain a proper distance to the image carrier 2. The interior of the development roller 5 includes a magnet to form given lines of magnetic force. Each electrostatic latent image formed by the laser light beam L on the surface of the image carrier 2 is developed by the development device containing a determined color toner into a visible toner image.

The image forming apparatus 1000 further includes a transfer device 15 below the image carriers 2C, 2M, 2Y, and 2K. The transfer device 15 includes an endless intermediate transfer belt 16. One end side of the intermediate transfer belt 16 is wound around a driven roller 17 and the other end side thereof is wound around a drive roller 18. As the drive roller 18 that is driven by a non-illustrated drive source rotates, the intermediate transfer belt 16 moves in a direction indicated by arrow. At this time, the surface of the image carrier 2 after passing the facing portion with the development roller 5 contacts an upper surface of the intermediate transfer belt 16.

Four primary transfer rollers 19C, 19M, 19Y, and 19K are provided in an inner loop of the intermediate transfer belt 16, facing the image carriers 2C, 2M, 2Y, and 2K with the intermediate transfer belt 16 interposed therebetween.

A belt cleaning device 21 is disposed in the vicinity of the right end side on the outer circumference of the intermediate transfer belt 16 to remove residual toner and foreign material such as paper dust remaining on the outer surface of the intermediate transfer belt 16.

The intermediate transfer belt 16 is a belt employing a resin film base or a rubber material base having a thickness of from 50 μm to 600 μm. Application of biases to the toner images held on the image carriers 2C, 2M, 2Y, and 2K can obtain resistance to transfer the toner images onto the surface of the intermediate transfer belt 16. The primary transfer rollers 19C, 19M, 19Y, and 19K are covered with a conductive rubber material on the surface of the metallic roller that functions as a cored bar, for example, to which a bias is applied from a non-illustrated power source. As an example of conductive rubber material, conductive urethane rubber dispersed with carbon can be used. The conductive rubber material is adjusted to have volume resistivity of approximately $10^5$ Ωcm. The primary transfer rollers 19C, 19M, 19Y, and 19K are not limited there to but can be a metallic roller with no rubber layer.

A secondary transfer roller 20 is disposed to face the drive roller 18 with the intermediate transfer belt 16 interposed therebetween at the outer circumference of the intermediate transfer belt 16. The secondary transfer roller 20 is covered with a conductive rubber material on the surface of the metallic roller that functions as a cored bar, for example, to which a bias is applied from a non-illustrated power source. The conductive rubber material is dispersed with carbon and is adjusted to have volume resistivity of approximately $10^7$ Ωcm.

The secondary transfer roller 20 contacts the intermediate transfer belt 16 at a position facing the drive roller 18, forming a secondary transfer nip are as a secondary transfer portion. In the secondary transfer nip area, a bias is applied while a paper P that functions as a recording material is passing between the intermediate transfer belt 16 and the secondary transfer roller 20, so that the toner image formed on the surface of the intermediate transfer belt 16 is electrostatically transferred onto the paper P.

A powder collecting device 10 is located between the intermediate transfer belt 16 and the sheet tray 30 disposed below the intermediate transfer belt 16 to collect waste toner. Residual toner remaining on the surface of the intermediate transfer belt 16 is scraped to transport to the powder collecting device 10.

Relatively large space is formed in a vertical direction between the sheet tray 30 and the secondary transfer roller 20 of the image forming apparatus 1000, so as to locate guides 55 and 56 and a pair of timing rollers 32 therebetween. Consequently, another space is formed vertically between the intermediate transfer belt 16 and the sheet tray 30. This space is effectively used to place the powder collecting device 10 therebetween, resulting in a downsizing of the image forming apparatus 1000.

The sheet tray 30 includes a bottom plate 46 to place the paper stack thereon and a sheet conveying roller 47.

The bottom plate 46 is rotatably supported by a support shaft at a left end side thereof and is movable vertically at a right free end side thereof. The bottom plate 46 is constantly biased upward by a biasing force exerted by a non-illustrated spring.

The sheet conveying roller 47 that functions as a rotary conveyance member is disposed at an upper outward portion of the sheet tray 30. The sheet conveying roller 47 contacts an uppermost paper on top of the paper stack placed on the bottom plate 46, so that the uppermost paper can be fed forward, toward a sheet conveying path 31. The sheet conveying roller 47 functions as a sheet conveying member to convey the paper P forward, and therefore the shape thereof may be other than a roller. For example, an endless belt wound around two rollers can be replaced with the sheet conveying roller 47.

A pair of timing rollers 32 is disposed at an end of the sheet conveying path 31. The pair of timing rollers 32 is disposed at an immediate upstream side of the intermediate transfer belt 16 to stop the paper P to be sagged temporarily so as to cause the toner image formed on the intermediate transfer belt 16 and the leading edge of the paper P to meet accurately. Then, immediately before the toner image formed on the surface of the intermediate transfer belt 16 is transferred onto the paper P in the secondary transfer nip area, the paper P temporarily halted is conveyed to the secondary transfer nip area at a given timing.

Many of a full front operation type image forming apparatus such as the image forming apparatus 1000, as illustrated in FIGS. 1 and 2, include a duplex unit 9 at a front side of the intermediate transfer belt 16. Consequently, there are not sufficient spaces at a front side of the secondary transfer roller 20 and a front side of the pair of timing rollers 32. Therefore, the nip area of the secondary transfer roller 20 and the nip area of the pair of timing rollers 32 are arranged in a diagonal or slanted direction to contribute to space-saving. Specifically, the secondary transfer roller 20 uses a large size spring, which is a compression spring 25. By disposing the compression spring 25 in the diagonal or slanted direction, the space in the duplex unit 9 can be used effectively, thereby reducing space of the image forming apparatus 1000 for both the front and rear sides.

The pair of timing rollers 32 of FIG. 2 is disposed closer to a rear side of the image forming apparatus 1000 than the intermediate transfer belt 16. Therefore, if a cover-side roller of the pair of timing rollers 32 is disposed at the position as illustrated in FIG. 2, when the cover 8 moves around a rotation track A2 of a radius R2 about a rotary shaft 12 of the cover 8, the cover 8 interferes with the drive roller 18. To avoid this interference, a non-illustrated retreat mechanism swings the cover-side roller of the pair of timing rollers 32 toward the inside of the radius R2 of the rotation track A2 while the cover 8 is opening.

A post-transfer conveying path 33 is disposed above the nip area formed by the secondary transfer roller 20 and the drive roller 18. Further, a fixing device 34 is disposed in the vicinity of an end portion of the post-transfer conveying path 33. The fixing device 34 includes a fixing roller 34*a* and a pressure roller 34*b*. The fixing roller 34*a* includes a heat source such as a non-illustrated halogen lamp. The pressure roller 34*b* rotates while contacting against the fixing roller 34*a* with a given pressure. It is to be noted that the fixing device 34 is not limited thereto but can employ an endless belt or an induction heating (IH) system.

A post-fixing path 35 is disposed above the fixing device 34 and is divided at an end portion thereof into to two paths, which are a sheet discharging path 36 and a reverse conveying path 41. A switching member 42 is disposed at a side portion of the post-fixing path 35 that swings about a swing shaft 42*a*. A pair of sheet discharging rollers 37 that functions as a sheet discharging unit is disposed at an end portion of the sheet discharging path 36.

By swinging the switching member 42 to a position indicated by a solid line in FIG. 2, the paper P having a fixed toner image thereon is guided to the sheet discharging path 36 and is discharged and stacked on the sheet discharging tray 45 due to rotation of the pair of sheet discharging rollers 37. After image fixation to one side of the paper P, the trailing edge of the paper P to one side passes the switching member 42. At this time the switching member 42 swings to change the position indicated by the solid position counter-clockwise to rotate in an opposite direction, and the paper P is guided by the switching member 42. The paper P is conveyed to the pair of timing rollers 32 by the reverse sheet conveying rollers 43 and 44.

[Operation for Single Side Printing]

Next, a description is given of basic operations performed by the image forming apparatus 1000 for printing one side of the paper P.

In the image forming apparatus 1000 illustrated in FIG. 1, a non-illustrated controller of the image forming apparatus 1000 transmits a sheet conveyance signal to rotate the sheet conveying roller 47 of the sheet tray 30. The rotation of the sheet conveying roller 47 separates an uppermost paper P on top of the paper stack on the bottom plate 46 of the sheet tray 30 from a second paper and the other subsequent papers to be conveyed to the sheet conveying path 31. Upon arrival of the leading edge of the paper P at the nip area of the pair of timing rollers 32, the uppermost paper P is synchronized with movement of a toner image formed on the intermediate transfer belt 16 and stands by with the paper P sagged to correct skew at the leading edge of the paper P.

Next, a description is given of an example of an image forming operation performed by one process unit 1 (i.e., the process units 1C, 1M, 1Y, and 1K) of the image forming apparatus 1000.

First, the surface of the image carrier 2 (i.e., the image carriers 2C, 2M, 2Y, and 2K) is uniformly charged to a high potential (negative charging) by the charging roller 4 (i.e., the charging rollers 4C, 4M, 4Y, 4K). The laser light beam L is emitted from the exposure device 7 to the surface of the image carrier 2 based on image data. By so doing, the surface of the image carrier 2 is irradiated to decrease the potential on the irradiated portion of the surface thereof, so that an electrostatic latent image is formed on the surface of the image carrier 2. By contrast, fresh black toner is supplied from the toner bottle 6 (i.e., the toner bottles 6C, 6M, 6Y, and 6K) to an outer circumferential surface of the development roller 5 (i.e., the development rollers 5C, 5M, 5Y, and 5K). The black toner on the outer circumferential surface of the development roller 5 is electrostatically attracted to the electrostatic latent image formed on the surface of the image carrier 2, thereby developed to a visible toner image. The visible toner image is primarily transferred by the positively-charged primary transfer roller 19 (i.e., the primary transfer rollers 19C, 19M, 19Y, and 19K) onto the surface of the intermediate transfer belt 16 that is synchronized with movement of the image carrier 2. Formation, development, and primary transfer of the electrostatic latent image are performed sequentially by synchronizing with the image data in the process unit 1.

Thus, a four-color toner image that is formed by sequential transfer of the toner images of cyan, magenta, yellow, and black is formed on the surface of the intermediate transfer belt 16 and conveyed with the intermediate transfer belt 16 that moves in a direction indicated by arrow A in FIG. 1.

The drum cleaning device 3 (i.e., the drum cleaning devices 3C, 3M, 3Y, and 3K) removes residual toner remaining on the surface of the image carrier 2 (i.e., the image carriers 2C, 2M, 2Y, and 2K) after transfer of the image onto the surface of the intermediate transfer belt 16. The residual toner removed from the surface of the image carrier 2 is collected by a non-illustrated waste toner conveying unit to a waste toner container disposed in the process unit 1 (i.e., the process units 1C, 1M, 1Y, and 1K). A non-illustrated electrical discharging device removes residual electrical charge remaining on the image carrier 2 (i.e., the image carriers 2C, 2M, 2Y, and 2K) after cleaning operation.

As described above, after the toner image is transferred onto the intermediate transfer belt 16, the pair of timing rollers 32 and the sheet conveying roller 47 start driving to synchronize the paper P with movement of the toner image on the intermediate transfer belt 16 to be conveyed to the secondary transfer roller 20 that is charged positively. When the paper P is conveyed to the secondary transfer nip area of the secondary transfer roller 20, the toner image formed on the intermediate transfer belt 16 is transferred onto the paper P.

Residual toner and foreign materials remaining on the surface of the intermediate transfer belt 16 are removed therefrom to be ready for the subsequent image forming and transfer process. The residual toner and foreign material removed from the intermediate transfer belt 16 are conveyed by a non-illustrated waste toner conveying unit to be collected to the powder collecting device 10.

The paper P having the toner image thereon passes through the post-transfer conveying path 33 to the fixing device 34. The fixing device 34 causes the paper P held between the fixing roller 34*a* and the pressure roller 34*b* to fix the unfixed toner image on the paper P by application of heat and pressure. The paper P with the toner image fixed thereto is conveyed from the fixing device 34 to the post-fixing path 35.

When the paper P is conveyed from the fixing device 34, the switching member 42 is located at a position drawn with a solid line in FIG. 1 to open one end of the post-fixing path 35. After passing through the post-fixing path 35, the paper P is held between the pair of sheet discharging rollers 37 and is discharged to the sheet discharging tray 45 with the fixed image facing down.

[Operation for Duplex Printing]

Next, a description is given of basic operations performed by the image forming apparatus 1000 for printing both sides of the paper P.

In duplex printing, when the trailing edge of the paper P conveyed by the pair of sheet discharging rollers 37 passes through the post-fixing path 35, the switching member 42 rotates to a position drawing with a dotted line in FIG. 1 to close the one end of the post-fixing path 35. Substantially simultaneously, the pair of sheet discharging rollers 37 reverses its rotation to switchback the paper P to the reverse conveying path 41. The paper P traveling in the reverse conveying path 41 reaches the pair of timing rollers 32 via the reverse sheet conveying rollers 43 and 44, so that the paper P is synchronized with movement of a toner image formed on an opposite side of the intermediate transfer belt 16.

The toner image to be formed on the opposite side of the paper P is sequentially formed in the image forming process that starts when the paper P is conveyed to a given position. The image forming process performed for printing the toner image on the opposite side of the paper P is the same as the image forming for printing the full-color toner image on the front side of the paper P. Namely, the full-color toner image for the opposite side of the paper P is held on the surface of the intermediate transfer belt 16. However, since the leading edge and the trailing edge of the paper P is reversed in the sheet conveying path, the non-illustrated controller controls the exposure device 7 so that image data is emitted to the image carrier 2 from the bottom to the top in the sheet conveying direction.

When the paper P conveyed from the pair of timing rollers 32 passes the secondary transfer roller 20, the toner image formed on the surface of the intermediate transfer belt 16 is transferred onto the opposite side of the paper P. After the fixing device 34 fixes the toner image on the opposite side of the paper P to the paper P, the paper P sequentially passes through the post-fixing path 35, the sheet discharging path 36, and the pair of sheet discharging rollers 37 to be discharged to the sheet discharging tray 45. To enhance efficiency in duplex printing, two or more papers P can be conveyed in the sheet conveying path 31.

[Sheet Conveying Device]

The following descriptions are given of a sheet conveying device according to embodiments of the present invention. As illustrated in FIG. 2, the sheet conveying device in the following embodiments is basically configured to feed and convey papers including the paper P stacked on the bottom plate (i.e., the bottom plate 46) in the sheet tray (i.e., the sheet tray 30) to the sheet conveying path (i.e., the sheet conveying path 31) one by one by the sheet conveying roller (i.e., the sheet conveying roller 47).

A description is given of a configuration of a sheet tray 130 employing the friction pad system as a comparative example, with reference to FIGS. 3A through 3D.

Figure 3A:
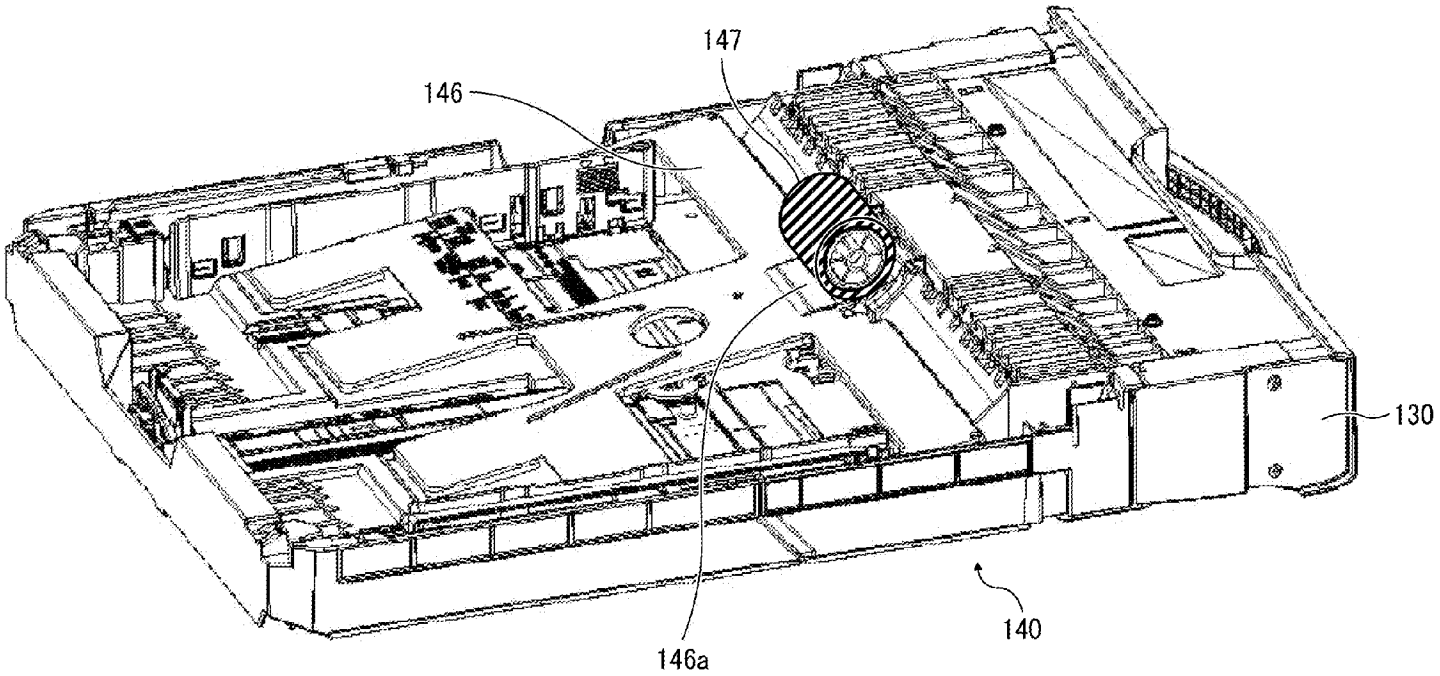
FIG. 3A is a perspective view illustrating a sheet tray including a comparative sheet conveying device.
Figure 3B:
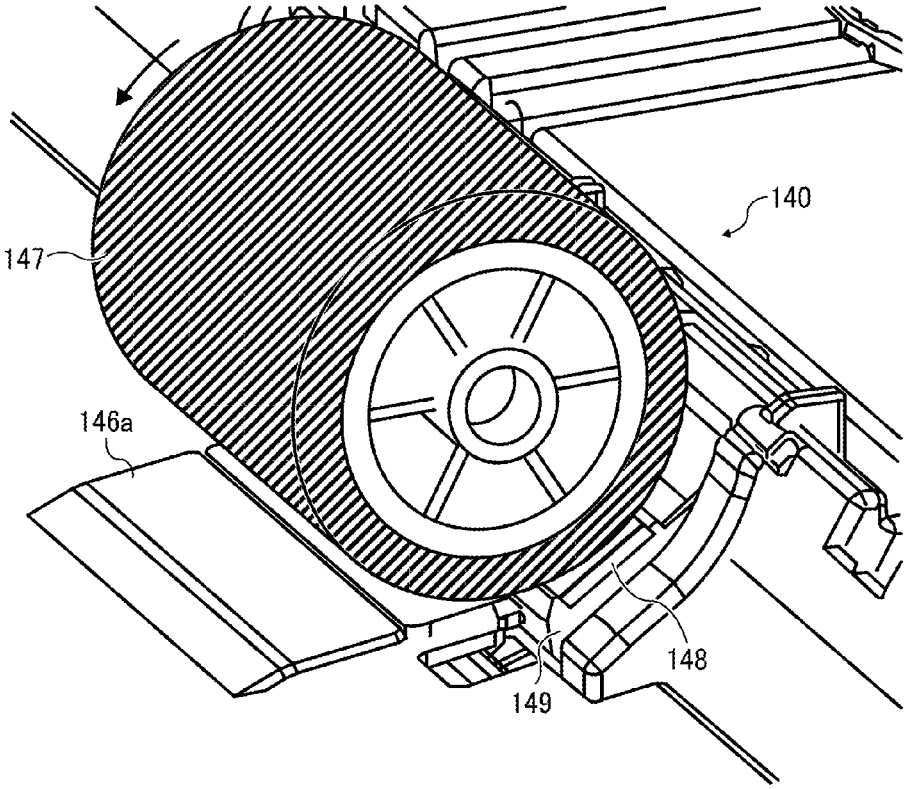
FIG. 3B is an enlarged perspective view illustrating the comparative sheet conveying device.
Figure 3C:
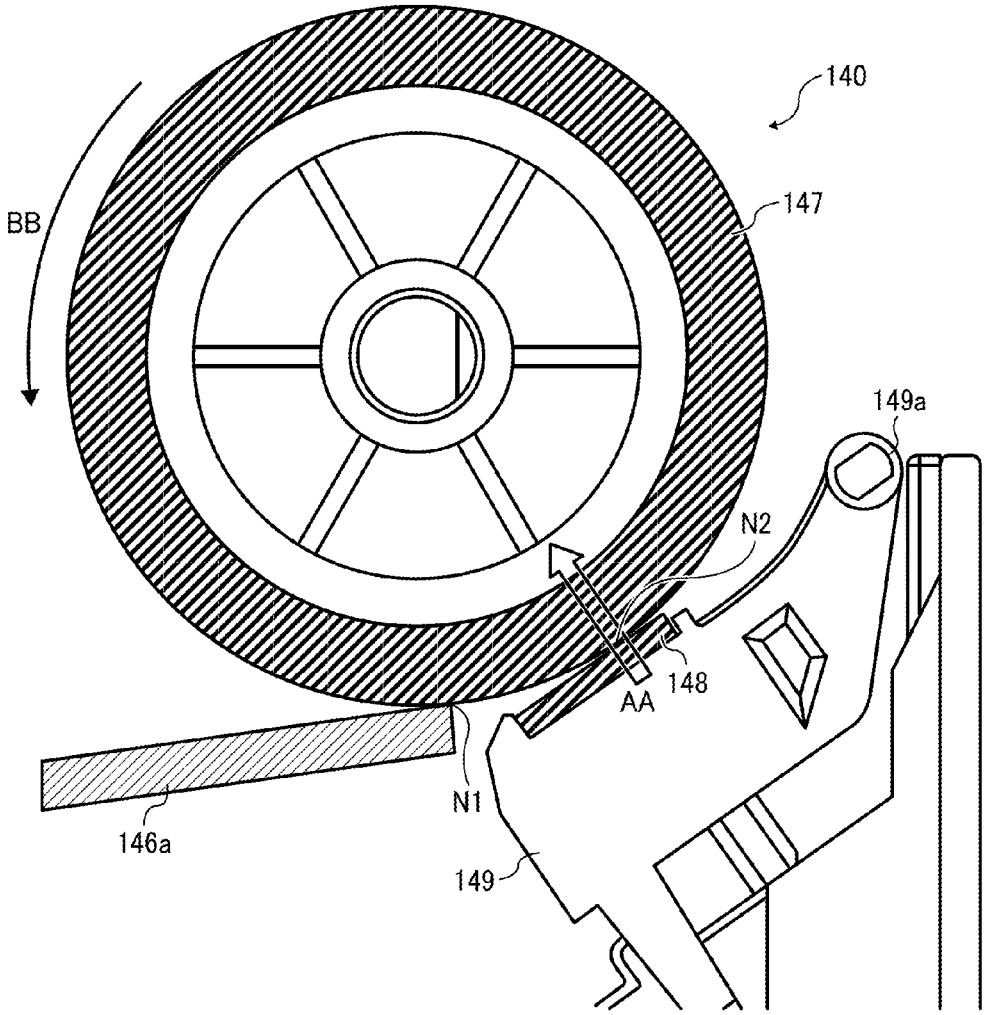
FIG. 3C is a side view illustrating the comparative sheet conveying device.

As illustrated in FIG. 3A, the sheet tray 130 includes a bottom plate 146. The left edge (or the trailing edge) of the bottom plate 146 is rotatably supported by the sheet tray 130 and is constantly biased upward by a non-illustrated spring. A stack of sheets is placed on the bottom plate 146. In addition, as illustrated in FIG. 3B and FIG. 3C, a friction pad 148 is disposed downstream from a front end portion 146*a* of the bottom plate 146 in a sheet conveyance direction with a given gap.

The friction pad 148 is attached to a pad holder 149. The pad holder 149 is rotatably supported by the sheet tray 130 at a support pin 149*a*, so as to rotate in upward and downward directions. A spring is disposed below the pad holder 149 to bias the pad holder 149 upward as indicated by arrow AA as illustrated in FIG. 3C.

While the sheet tray 130 is set in a body of an image forming apparatus (not shown), a sheet conveying roller 147 is disposed on the front end portion 146*a* of the bottom plate 146 in the image forming apparatus. As illustrated in FIG. 3C, an outer circumferential surface of the sheet conveying roller 147 contacts an overside of the front end portion 146*a* of the bottom plate 146 and an overside of the friction pad 148, where a conveyance nip area N1 and a separation nip area N2 are formed.

In the sheet conveying device with the friction pad system, the sheet slides on the overside of the friction pad 148. Depending on the settings of pressure on the conveyance nip area N1 and the separation nip area N2 and the types of sheets such as thick papers and thin papers, it is likely that abnormal sound caused by stick-slip, multiple feeding, and non-feeding occur easily in the separation nip area N2. Further, since the sheet slidably contact the lateral edges of the friction pad 148, it is likely to easily cause streaks on a sheet, turnover of a sheet, or both.

As described above, the settings of pressure on a conveyance nip area and a separation nip area and the types of sheets such as thick papers and thin papers affect on a sheet conveying device with the friction pad system. When the conveyance nip pressure is too high, a force of sheet feeding increases and may result in multiple feeding. By contrast, when the conveyance nip pressure is too low, a friction force of the friction pad becomes greater than the force of sheet feeding and may result in occurrence of non-feeding.

On the other hand, when the separation nip pressure is too low, a frictional force sufficient to separate the sheets cannot be exerted and may result in multiple feeding. By contrast, when the separation nip pressure is too high, an excess of friction force exerted between the friction pad and the sheet increases vibration of stick-slip and may result in unstable sheet feeding operation and accuracy, occurrence of abnormal sound, and/or an increase in noise.

Optimum regions of the conveyance nip pressure and the separation nip pressure originally vary depending on the types of paper such as thick paper and thin paper. The thick paper has a high rigidity and a great load on sheet conveyance, and therefore is easy to cause non-feeding. The thin paper has a low rigidity and a small load on sheet conveyance, and therefore is not likely to cause non-feeding easily but is likely to cause multiple feeding. To prevent non-feeding of thick papers and multiple feeding of thin papers together, the conveyance nip pressure and the separation nip pressure can be set to high values, for example.

However, as described above, a high separation nip pressure can produce abnormal sound due to the friction pad and the sheet in slidable contact with each other and increase sliding sound of the friction pad and the sheet. For making the sheet conveying device applicable to various paper types, the conveyance nip pressure and the separation nip pressure may need to be well balanced within the optimum regions.

Figure 3D:
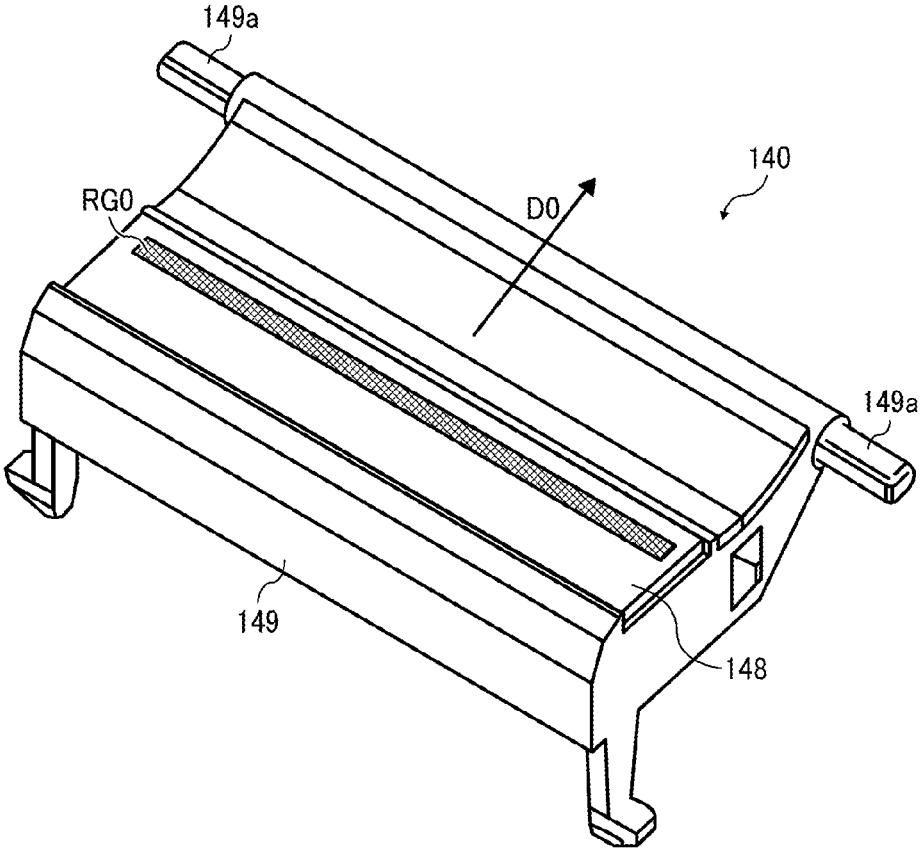
FIG. 3D is a perspective view illustrating a pad holder of the comparative sheet conveying device.

As illustrated in FIG. 3D, a region RG0 of the separation nip area N2 between the sheet and the friction pad 148 has a longitudinal slit shape. The region RG0 extends horizontally in a direction perpendicular to a sheet conveying direction D0. The longitudinal horizontal length of the region RG0 is the same as a longitudinal length of the sheet conveying roller 147. The lateral length of the region RG0 can be smaller to a linear shape. Depending on accuracy in each part or component of the image forming apparatus 1000, the sheet may contact the friction pad 148 at point(s) on at least one position at the end portions or middle portion of the region RG0.

As described above, the sheet conveying device 130 with the friction pad 148 system has the separation nip area N2 with a significantly small region and an unstable shape. Therefore, the friction pad 148 retains the sheet significantly unstably with an insufficient retaining force. Consequently, it is likely to cause vibration due to stick-slip, which may result in occurrence of abnormal sound and an increase in noise.

[Embodiment 1]

Figure 4:
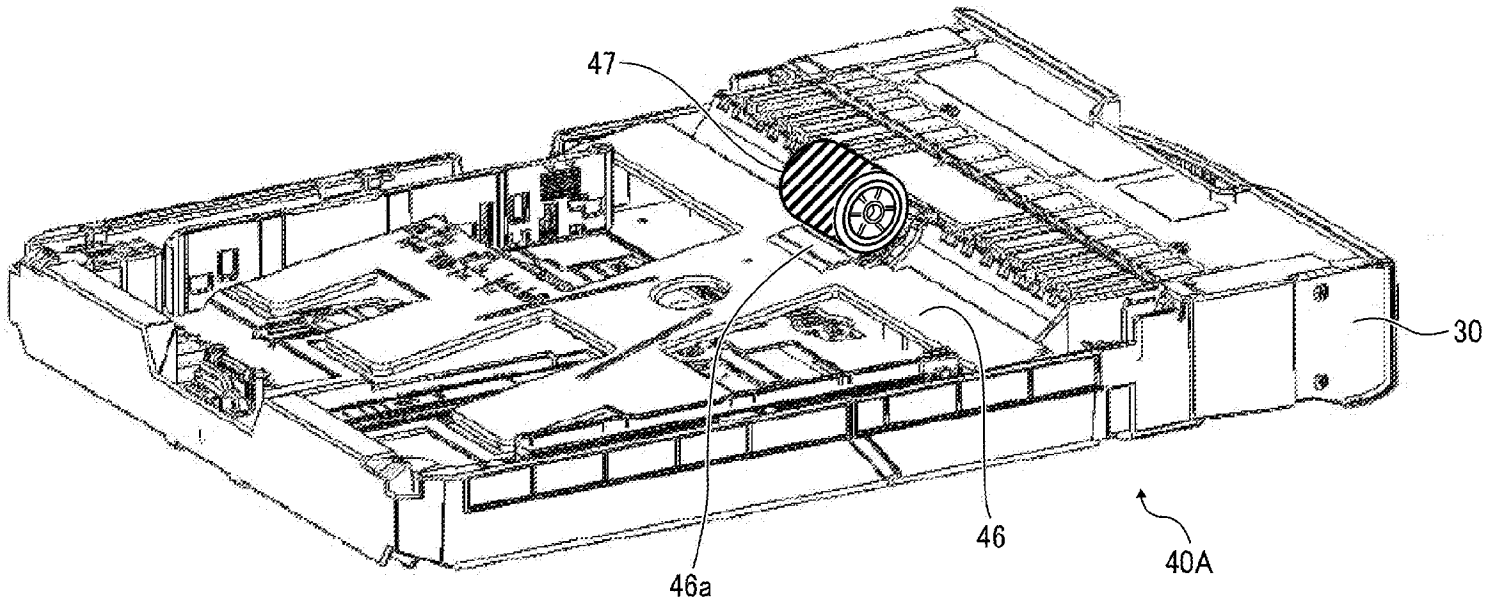
FIG. 4 is a perspective view illustrating the sheet conveying device according to Embodiment 1.
Figure 5:
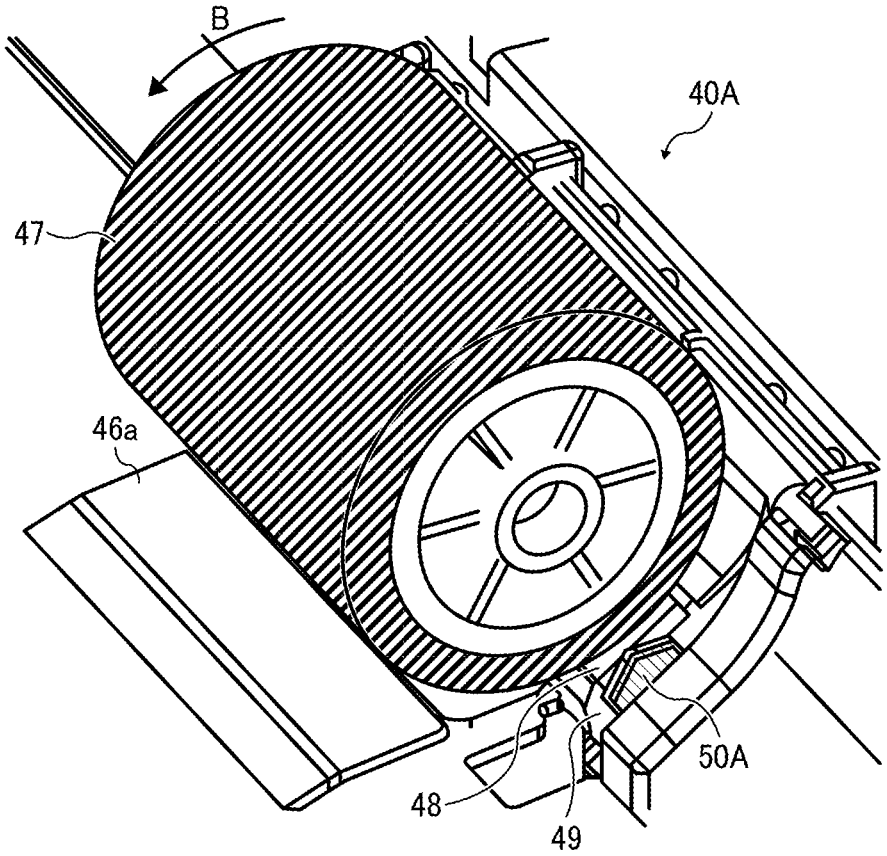
FIG. 5 is an enlarged perspective view illustrating the sheet conveying device according to Embodiment 1.
Figure 6:
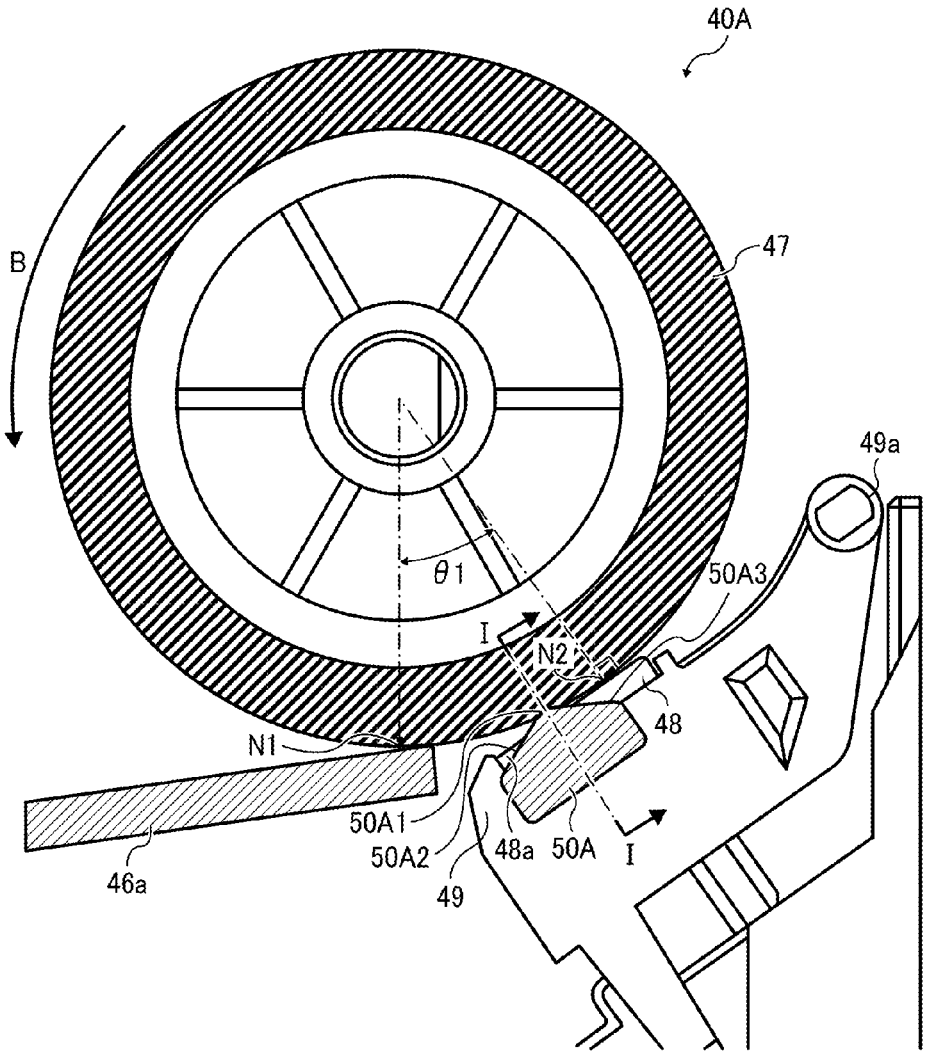
FIG. 6 is a cross-sectional view illustrating the sheet conveying device according to Embodiment 1.

Next, a description is given of a sheet conveying device 40A according to Embodiment 1 of the present invention, with reference to FIGS. 4 through 10. FIG. 4 is a perspective view illustrating the sheet tray 30 removed from the image forming apparatus 1000. FIG. 5 is an enlarged perspective view illustrating the sheet conveying roller 47 as shown in FIG. 4. FIG. 6 is a cross-sectional view illustrating the sheet conveying roller 47. FIG. 6 is a cross-sectional view of the sheet conveying roller 47. FIG. 7A is a perspective view illustrating a pad holder 49 included in the sheet conveying device 40A. FIG. 7B is a side view illustrating the pad holder 49. The paper P is omitted from these drawings except FIG. 7A for convenience.

The sheet conveying device 40A includes a pair of guides 50A as shown in FIGS. 5 through 10. The pair of guides 50A can be formed into various shapes such as the pair of guides 50A (Embodiment 1) through 50H (Embodiment 7) with reference to FIGS. 4 through 10 and FIGS. 12A through 20B. FIG. 11 is a graph of results of frequency analysis using FFT regarding vibration generated in the pad holder 49 of the sheet conveying device 40A according to Embodiment 1 and vibration generated in a pad holder (i.e., the pad holder 149) of a known sheet conveying device (i.e., the sheet conveying device 140). A description along with FIG. 11 will be given after the operations in Embodiment 1.

As illustrated in FIG. 4, a bottom plate 46 is disposed in the box-shaped sheet tray 30. The bottom plate 46 has a left end (or a trailing end) rotatably supported by the sheet tray 30 and constantly biased upward by a non-illustrated spring. The paper stack is placed on the bottom plate 46.

As illustrated in FIGS. 5 and 6, a friction pad 48 functions as a friction member and is disposed at a front or downstream side of a front end portion 46*a* of the bottom plate 46 with a given gap therebetween. The friction pad 48 uses a plate-like base material cut in given size and shape to be attached to the pad holder 49 to be in a planar shape. The friction pad 48 can employ various types of material such as cork rubber material and urethane foam rubber material. Cork rubber material is reasonable for the cost of the friction pad 48. The friction coefficient of the friction pad 48 is generally greater than the friction coefficient between the papers. The difference of these friction coefficients prevents occurrence of multiple feeding.

The pad holder 49 is vertically rotatable about a support pin 49*a* disposed at the downstream side thereof in the sheet conveying direction to be rotatably supported to the sheet tray 30. A non-illustrated spring is disposed below the pad holder 49 to bias the pad holder 49 and the friction pad 48 upward or toward a rotation center of the sheet conveying roller 47. The support configuration of the pad holder 49 is not limited to the above-described configuration in which the pad holder 49 is rotatably supported about the supporting pin 49*a*. For example, the pad holder 49 can be aligned linearly movably in a horizontal direction toward the rotation center of the sheet conveying roller 47 in FIG. 6 according to a layout design of parts disposed in the vicinity of the pad holder 49.

As illustrated in FIG. 2, the sheet conveying roller 47 is disposed at a ceiling of inner space of the sheet tray 30 in a body of the image forming apparatus 1000 as illustrated in FIG. 2 and is attached with the sheet tray 30 attached to the image forming apparatus 1000 as illustrated in FIGS. 4 through 6. Namely, the sheet conveying roller 47 is disposed at a lateral center of the sheet tray 30 and above the front end portion 46*a* of the bottom plate 46 and the friction pad 48. As illustrated in FIG. 6, an outer circumferential surface of the sheet conveying roller 47 contacts an overside of the front end portion 46*a* of the bottom plate 46 and an overside of the friction pad 48, so that a conveyance nip area N1 and a separation nip area N2 are formed at the contact portions of the bottom plate 46 and the friction pad 48, respectively.

A rotary shaft of the sheet conveying roller 47 extends horizontally in a direction perpendicular to the sheet conveying direction of the paper P. The rotary shaft is rotated by a sheet conveying roller drive mechanism that is driven by a non-illustrated drive source, and therefore the sheet conveying roller 47 is rotated in a direction indicated by arrow B in FIGS. 5 and 6. The rotary shaft of the sheet conveying roller 47 is biased downward by an elastic force of a non-illustrated spring. When attachment of the sheet tray 30 to the body of the image forming apparatus 1000 is completed, a lower portion of the outer circumferential surface of the sheet conveying roller 47 contacts an uppermost paper P of the paper stack with a given pressure. The contact position is the same as the conveyance nip area N1. The distance from the contact position to the separation nip area N2 disposed downstream therefrom can be set within 45 degrees of an angle of rotation θ1 of the sheet conveying roller 47, which is $\theta 1 \leq 45$ degrees.

The width of the sheet conveying roller 47 is determined to be 50 mm for the purpose of a reduction in size of the sheet conveying roller 47. The lower portion of the outer circumferential surface of the sheet conveying roller 47 contacts the lateral center of the paper P.

It is to be noted that the above-described width of the sheet conveying roller 47 is one example. The optimal width of the sheet conveying roller 47 as well as a diameter thereof can be set based on test data so as to prevent multiple feeding or non-feeding depending on types of paper P to be used.

The pair of guides 50A is disposed at both lateral end sides of the pad holder 49 and both lateral end sides of the friction pad 48. The pair of guides 50A is integrally formed with the pad holder 49 using the same material. By disposing the pair of guides 50A at both lateral end sides of the friction pad 48, the friction pad 48 can be a simple shape such as a rectangular shape. In addition, design freedom or flexibility in the shape and position of the pair of guides 50A can be obtained, thereby reducing the whole size of the sheet conveying device 40A. Further, since the pair of guides 50A is integrally formed with the pad holder 49, the number of parts does not increase and accuracy of dimension of the pair of guides 50A can be obtained easily, thereby contributing to a low-cost, high-quality sheet conveying device 40A. Further, by providing two (pair) or more guides 50A in a lateral direction that is perpendicular to the sheet conveying direction, a conveying load caused by a frictional force generated between the pair of guides 50A and the paper P can be equal in both right and left sides of the paper P, thereby preventing skew (rotation) of the paper P. Accordingly, the pair of guides 50A is preferably provided in a pair or an even number in both lateral (right and left) sides.

The pad holder 49 can include a resin material such as PS, ABS, and POM. To prevent frictional charging with the paper P, a conductive resin or a metallic material is used to remove static electricity from the pad holder 49. When a metallic material is used, die-cast aluminum is preferable for easy forming in reasonable cost. Further, by connecting the pad holder 49 to a non-illustrated earth path, a more reliable image formed on the intermediate transfer belt 16 can be transferred onto the paper P.

Each of the pair of guides 50A has a pentagonal shape arranged substantially bilaterally symmetrical and includes a top portion 50A1 at the center thereof. The top portion 50A1 according to the present embodiment has an obtuse angle of about 130 degrees. However, the angle of the top portion 50A1 is not limited to the obtuse angle and can be set in a wide range of from an obtuse angle to an acute angle, depending on the height and other conditions of the top portion 50A1.

Upper surfaces 50A2 and 50A3 that are formed in pair are disposed at both lateral sides of the top portion 50A1. Each of the upper surfaces 50A2 and 50A3 is formed in a flat shape.

Figure 8:
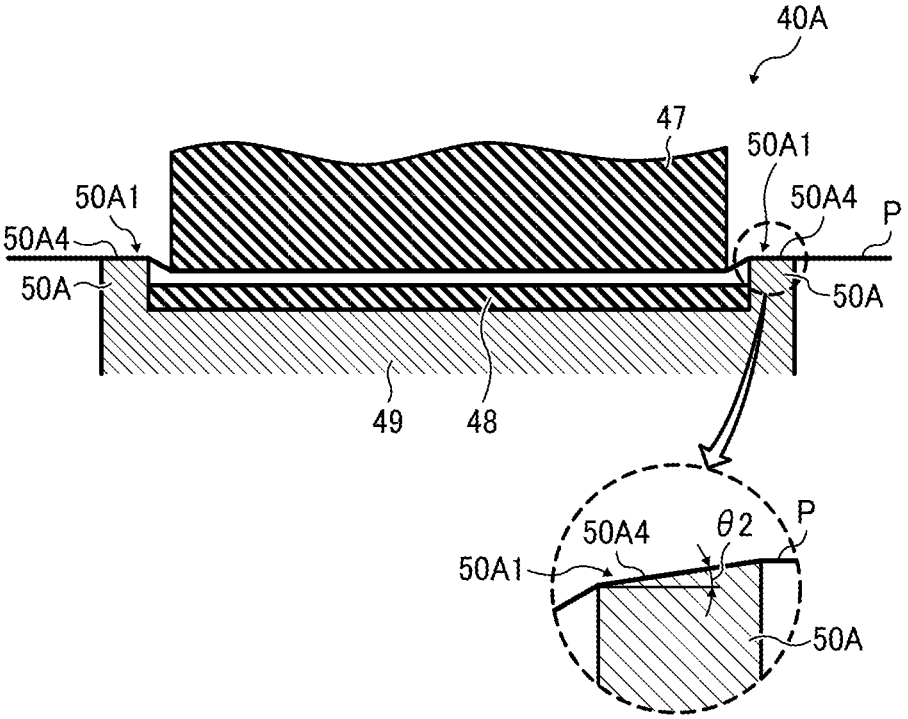
FIG. 8 is a cross-sectional view along a line I-I of FIG. 6.

At a boundary of the upper surfaces 50A2 and 50A3, a ridgeline 50A4 having a short length is formed as illustrated in FIG. 8, which shows a cross-sectional view of the sheet conveying device 40A along a line I-I of FIG. 6. The ridgeline 50A4 may be substantially horizontally flat or have a slope with an angle θ2 inward, as illustrated in FIG. 8. It is preferable that the angle θ2 of the slope is set to an angle with which the paper P can contact in line with the ridgeline 50A4.

Figure 7A:
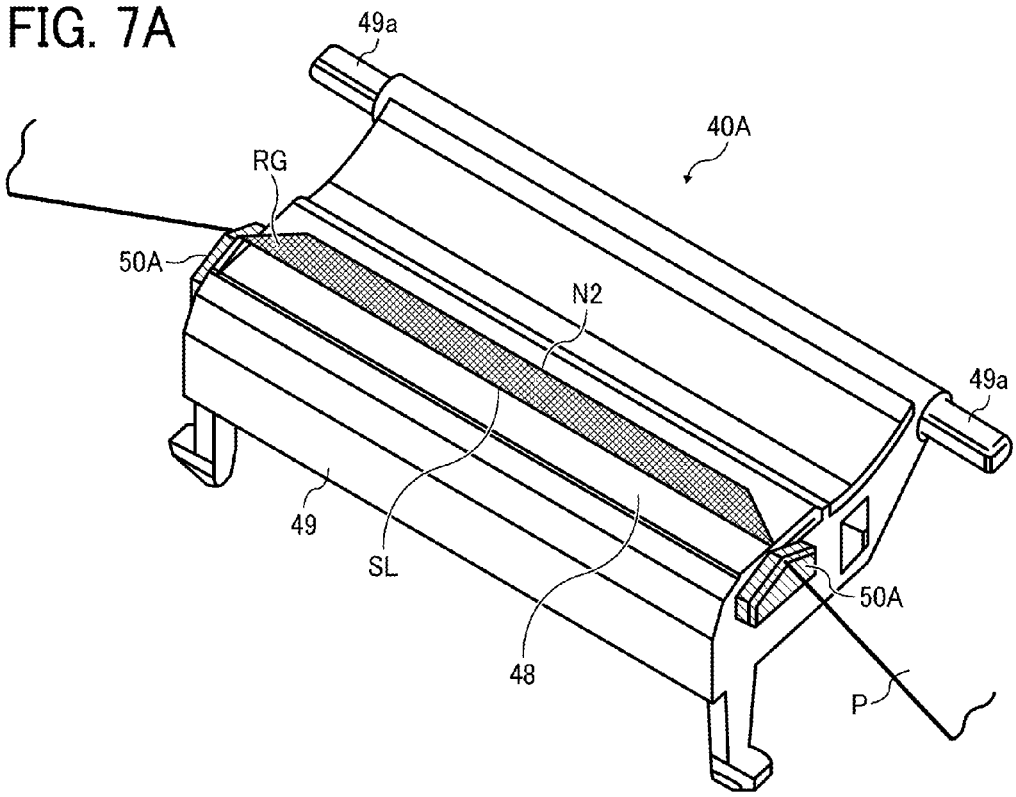
FIG. 7A is a perspective view illustrating a pad holder included in the sheet conveying device according to Embodiment 1.
Figure 7B:
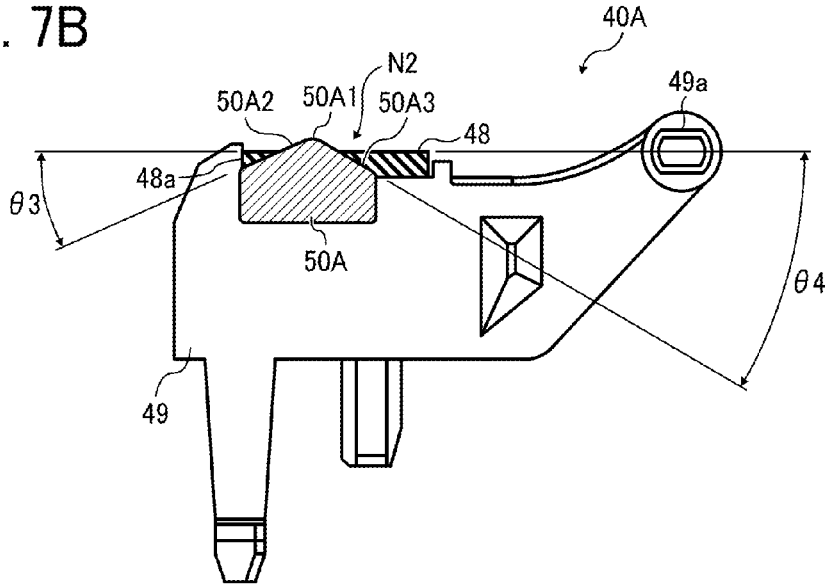
FIG. 7B is a side view illustrating the pad holder of the sheet conveying device according to Embodiment 1.

The flat surface 50A2 that is arranged at an upstream side of each of the pair of guides 50A is an upward slope guide surface. As illustrated in FIG. 7B, an angle θ3 formed from the separation nip area N2 of the friction pad 48 to the overside of the friction pad 48 toward an upstream end of the friction pad 48 in the sheet conveying direction, the upward slope guide surface can be formed preferably in a range of 0 degree≤θ3≤45 degrees, and more preferably in a range of 5 degree≤θ3≤30 degrees. Accordingly, an angle of approach of the paper P with respect to the pair of guides 50A becomes gentle, thereby preventing non-feeding caused by an excess of conveying load.

Further, the flat surface 50A3 that is arranged at a downstream side of each of the pair of guides 50A is a downward slope guide surface. As illustrated in FIG. 7B, an angle θ4 formed from the separation nip area N2 of the friction pad 48 to the overside of the friction pad 48 toward a downstream end of the friction pad 48 in the sheet conveying direction, the downward slope guide surface can be formed preferably in a range of 0 degree≤θ4≤90 degrees, and more preferably in a range of 5 degree≤θ4≤45 degrees. Accordingly, an angle of approach of the paper P with respect to the pair of guides 50A becomes gentle, thereby preventing non-feeding caused by an excess of conveying load. As a result, the trailing edge of the paper P can prevent collision thereof to a subsequent paper when the paper P leaves from the pair of guides 50A, thereby enhancing quietness by preventing collision of the friction pad 48 to the surface on the downstream side thereof.

The upper surfaces 50A2 and 50A3 of the pair of guides 50A may have a non-flat face. For example, the upper surfaces 50A2 and 50A3 of the pair of guides 50A may have an arc-shaped or protruding curved face in a cross-sectional view as illustrated in FIGS. 9A and 9B.

Figure 9A:
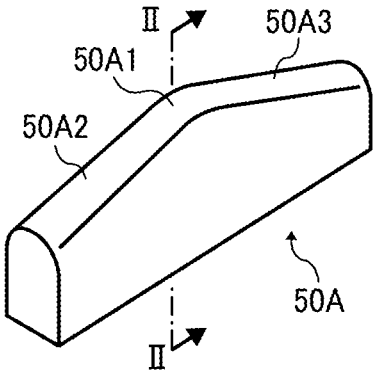
FIG. 9A is a perspective view illustrating a modified guide portion of the sheet conveying device according to Embodiment 1.
Figure 9B:
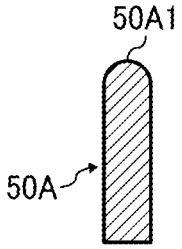
FIG. 9B is a cross-sectional view along a line II-II of FIG. 9A.

FIG. 9A is a perspective view illustrating either of the pair of guides 50A. FIG. 9B is a cross-sectional view illustrating either of the pair of guides 50A along a line II-II of FIG. 9A.

With the protruding curved face, the upper surfaces 50A2 and 50A3 do not form a ridgeline clearly to intersect at the boundary thereof or form a ridgeline that intersects at a small angle that is relatively invisible. By employing such a curved face or gentle ridgeline of the pair of guides 50A, a conveying resistance of the paper P can be reduced to prevent damage to the paper and to reduce frictional wear of the pair of guides 50A with the paper P.

Figure 10:
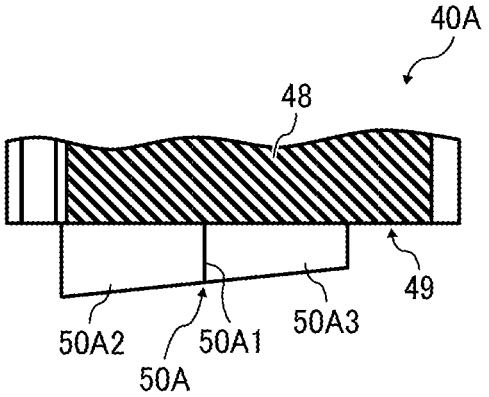
FIG. 10 is a plan view illustrating a yet another modified guide portion of the sheet conveying device according to Embodiment 1.
Figure 11:
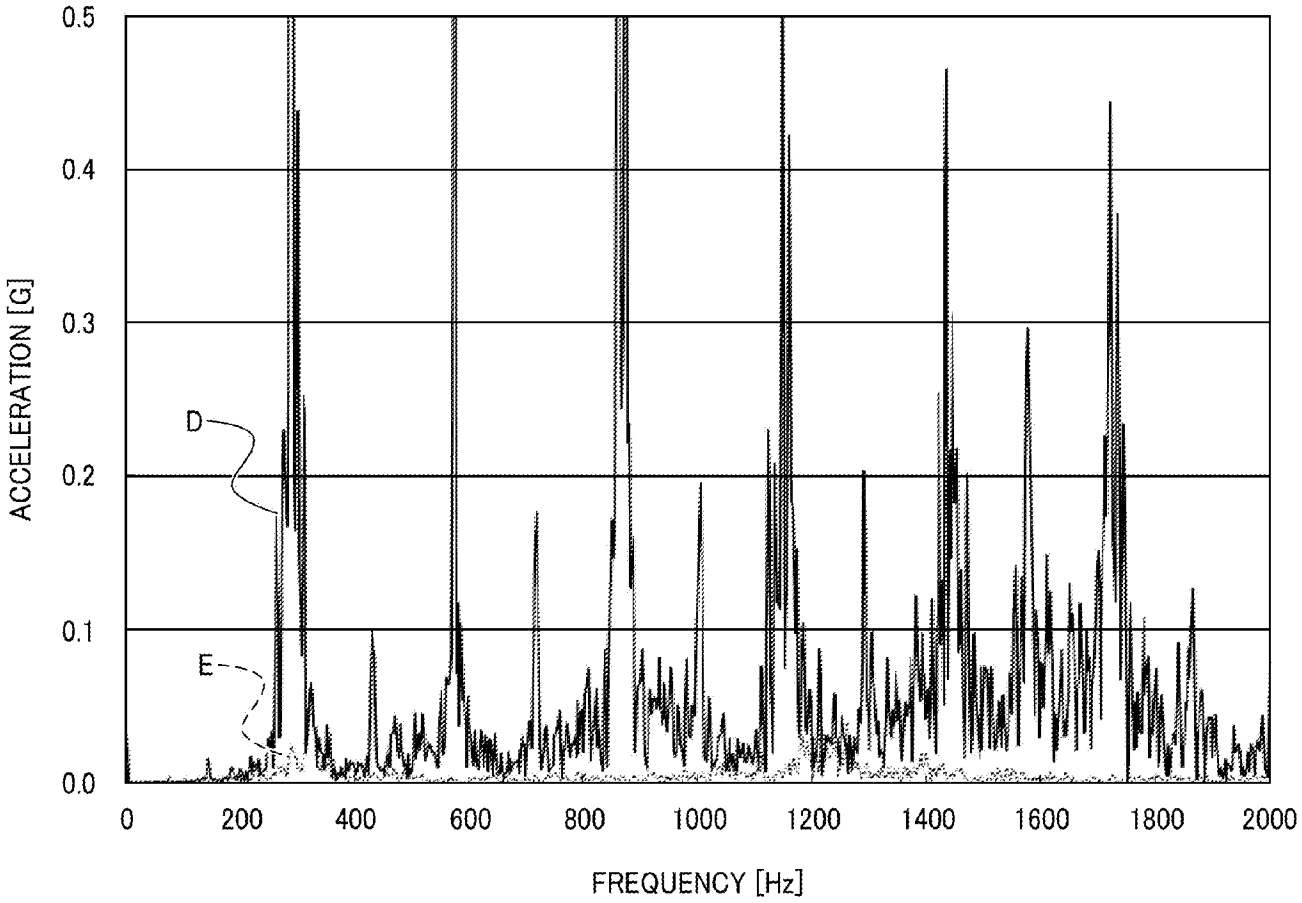
FIG. 11 is a graph showing frequency analysis by using FFT regarding vibration caused on the pad holder of the sheet conveying device according to Embodiment 1 and a pad holder of the comparative sheet conveying device.

The upper surfaces 50A2 and 50A3 of the pair of guides 50A may have the same width or have a tapered width gradually narrowed downwardly in the sheet conveying direction, as illustrated in FIG. 10. By employing the upper surfaces 50A2 and 50A3 having a tapered width, the leading edge of the paper P is received at the upper surface 50A2 having a wider width to disperse the conveying load and the trailing edge of the paper P slidably contacts the upper surface 50A3 to reduce the conveying resistance of the paper P, thereby reducing damage on the paper P. The pair of guides 50A has a tapered structure formed entirely from the upper surface 50A2 to the upper surface 50A3 as illustrated in FIG. 10 but not limited thereto. For example, the tapered structure may be formed on either one of the upper surface 50A2 and the upper surface 50A3 while the other has a constant width.

The sheet conveying device 40A of FIG. 6 is illustrated viewing from the axial direction of the sheet conveying roller 47. As illustrated in FIG. 6, the top portion 50A1 of the pair of guides 50A is disposed upstream from the separation nip area N2 and downstream from the pad upstream end 48*a* of the friction pad 48 in the sheet conveying direction. In the present embodiment, the top portion 50A1 of the pair of guides 50A is located at a substantially center portion between the separation nip area N2 and the pad upstream end 48*a* of the friction pad 48. This structure prevents direct contact of the leading edge of the paper stack against the pair of guides 50A. According to this structure, the leading edge of the paper stack contacts the upstream surface that is close to the pad upstream end 48*a* of the friction pad 48 obliquely, so that the leading edge of the paper stack is flipped through in a cascade manner in the sheet conveying direction, thereby preventing multiple feeding of the paper P.

Further, as illustrated in FIG. 6, the top portion 50A1 of the pair of guides 50A is substantially even with the edge of the surface of the sheet conveying roller 47 when viewed in the axial direction of the sheet conveying roller 47. Namely, the top portion 50A1 elevates to a height at which the top portion 50A1 can cuts in the outer circumferential surface of the sheet conveying roller 47. The position of the top portion 50A1 between the separation nip area N2 and the pad upstream end 48*a*, the height of the top portion 50A1, and the degrees of angles of inclination 82 through 84 can be determined to optimal values that generate a smallest vibration or abnormal sound, after vibration and abnormal sound of the pad holder 49 in sheet conveyance are tested and checked with multiple prototype sheet conveying devices.

As described above, by providing the pair of guides 50A disposed at both lateral sides of the friction pad 48, the paper P can be supported by the pair of guides 50A at the upstream side of the separation nip area N2 in addition to retention of the paper P at the separation nip area N2. When the pair of guides 50A lifts up the paper P, the paper P is pressed against the sheet conveying roller 47 on a straight line SL that connects the pair of guides 50A. With the paper P held at multiple points, the region of the separation nip area N2 is expanded practically as indicated with a region RG having a trapezoidal area as illustrated in FIG. 7A, and therefore the overside of the paper P contacts the outer circumferential surface of the sheet conveying roller 47 in the trapezoidal area of the region RG.

Practical expansion of the separation nip area N2 can provide stability in the contact region and the contact state of the paper P on the lower side thereof facing the friction pad 48 and increase the retaining force of the paper P by the friction pad 48, resulting in prevention of multiple feeding and noise of the paper P. Further, the practical expansion of the separation nip area N2 can provide stability in the contact region and the contact state of the upstream paper P on the upper side thereof facing the outer circumferential surface of the sheet conveying roller 47 and increase the separation conveying force of the sheet conveying roller 47, resulting in prevention of non-feeding and noise of the paper. The trapezoidal area of the region RG is separated from the friction pad 48 and has a three-dimensional shape along the outer circumferential surface of the sheet conveying roller 47. It may be considered that the shape of the region RG functions as a cushioning that softly reduce and absorb vibration causing abnormal sound at the separation nip area N2.

The sheet conveying device 40A according to Embodiment 1 is formed as described above. FIG. 11 is the graph showing the test results of vibration acceleration by comparing the sheet conveying device 40A according to Embodiment 1 and the conventional sheet conveying device 140 as illustrated in FIGS. 3A through 3D. The sheet conveying device 40A according to Embodiment 1 and the sheet conveying device 140 are identical in structure, material, etc., except for existence of the pair of guides 50A.

The following units and components are used in the test.

Material of friction pad: Urethane foam rubber;

Material of holder: polycarbonate (PC);

Material of sheet conveying roller: EPDM (ethylene propylene diene monomer);

Diameter of sheet conveying roller: ϕ36 mm;

Conveyance speed of sheet conveying roller: 60 mm/s;

Width of separation nip area (width of sheet conveying roller): 50 mm;

Separation nip pressure: 3N;

Paper type: Plain paper (Askul, Multi paper, Super white, A4-size)

Angle of paper approach: 30 degrees;

Measuring instruments: Accelerometers 352C22 manufactured by PCB); and

FFT analyzer (Multi-Channel Data Station DS-2100 manufactured by Ono Sokki Company Ltd.).

The waveforms representing vibration generated in the pad holder 49 of the sheet conveying device 40A according to Embodiment 1 and vibration generated in the pad holder 149 of the sheet conveying device 140, shown in FIG. 11, are put into to a graph by frequency analysis using FFT. A horizontal line of the graph represents a frequency [Hz] and a vertical line of the graph represents acceleration [G] (1G=0.01 m/s2). The waveform E indicated by a dotted line shows the result of vibration generated in the pad holder 49 according to Embodiment 1 and the waveform D indicated by a solid line shows the result of vibration generated in the pad holder 149 where the pair of guides 50A are not provided. The greater acceleration value [G] generates the greater abnormal noise. This abnormal noise is caused by vibration of stick-slip of the paper P to the friction pad 48.

The maximum scale value of acceleration of FIG. 11 is 0.5 G and the maximum scale value of frequency is 2,000 Hz. The test results show that the sheet conveying device 40 according to Embodiment 1 has the maximum acceleration of 0.06 G in the frequency range of from 0 Hz to 2,000 Hz while the sheet conveying device 140 has the maximum acceleration of 4.71 G in the frequency range of from 0 Hz to 2,000 Hz. The test results have confirmed that the sheet conveying device 140 has the vibration value that is substantially 77 times greater than the sheet conveying device 40. In the graph of FIG. 11, the maximum scale value in the vertical line is 0.5 G and the waveform D having the value above 0.5 G is omitted.

According to the test results of FIG. 11, compared with the sheet conveying device 140 that does not include the pair of guides 50A, the sheet conveying device 40A according to Embodiment 1 can significantly reduce vibration. Therefore, the pair of guides 50A of the sheet conveying device 40A according to Embodiment 1 has been proved to prevent vibration of stick-slip generated by sliding contact of the friction pad 48 and the paper P, stabilize sheet conveyance action and accuracy, and reduce and prevent generation of abnormal sound due to prevention of vibration.

[Embodiment 2]

Figure 12A:
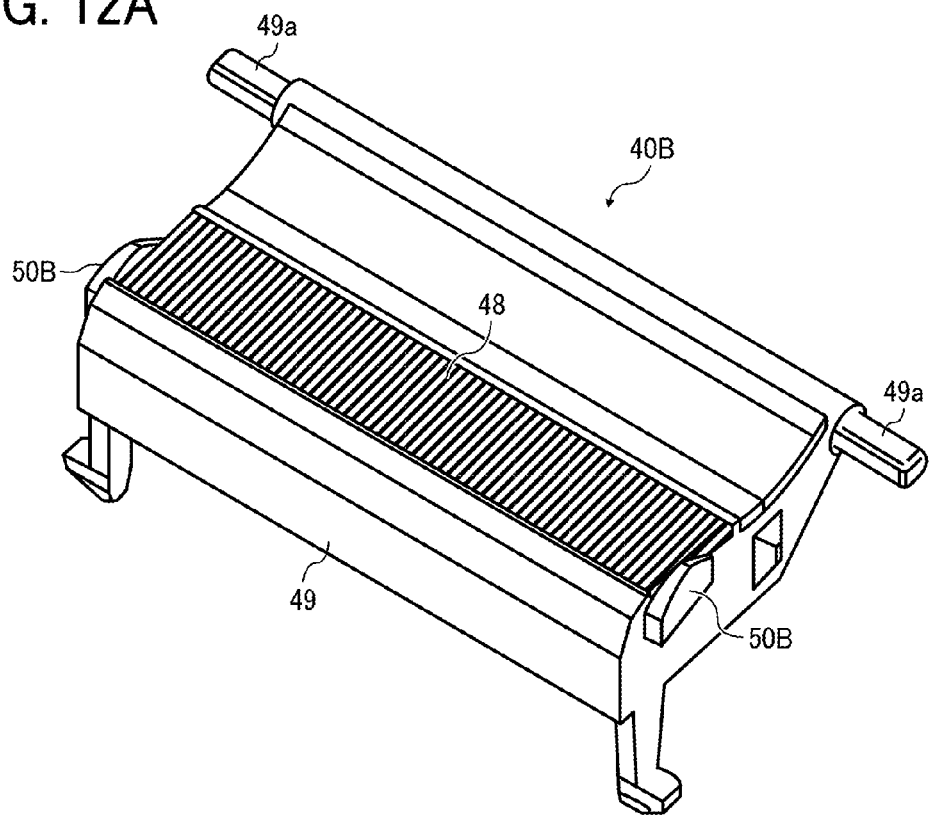
FIG. 12A is a perspective view illustrating a pad holder included in a sheet conveying device according to Embodiment 2.
Figure 12B:
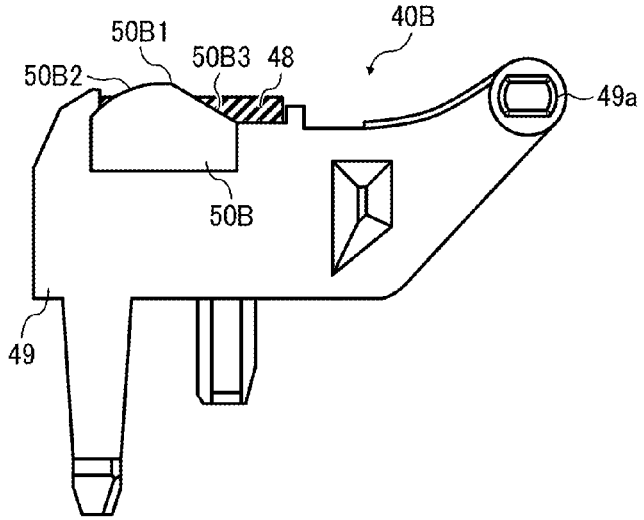
FIG. 12B is a side view illustrating the pad holder of the sheet conveying device according to Embodiment 2.

A description is given of a configuration and operations of a sheet conveying device 40B according to Embodiment 2, with reference to FIGS. 12A and 12B.

The sheet conveying device 40B according to Embodiment 2 includes a pair of guides 50B as illustrated in FIGS. 12A and 12B. Each of the pair of guides 50B has an upwardly projecting arc shape as viewed from the axial direction of the sheet conveying roller 47 so that an upstream upper surface 50B2 disposed upstream from a top portion 50B 1 of the guide 50B is located higher than the top portion 50B1 of the guide 50B. Each of the pair of guides 50B has a downstream upper surface 50B3 disposed downstream from the top portion 50B1 to be a flat surface slanted as same as the upper surface 50A3 of Embodiment 1. The other features of the configuration of the sheet conveying device 40B are the same as the configuration of the sheet conveying device 40A of Embodiment 1.

By forming the upstream upper surface 50B2 to have the arc shape, an angle of approach for the leading edge of the paper P to come over the upper surface of the pair of guides 50B becomes gentle. As a result, non-feeding due to exceed of conveying load can be prevented.

The downstream upper surface 50B3 may have an upwardly projecting arc shape as same as the upstream upper surface 50B2. By forming the downstream upper surface 50B3 to have the arc shape, collision of the trailing edge of the paper P to a subsequent paper when the paper P leaves from the pair of guides 50B can be prevented and therefore noise caused by collision of the paper P to the downstream surface of the friction pad 48 can be reduced. Further, by forming the upper surfaces 50B2 and 50B3 of the guide portion to an arc (curved) shape, the parts can be manufactured easily, thereby providing a low-cost high-accuracy sheet conveying device.

[Embodiment 3]

Figure 13A:
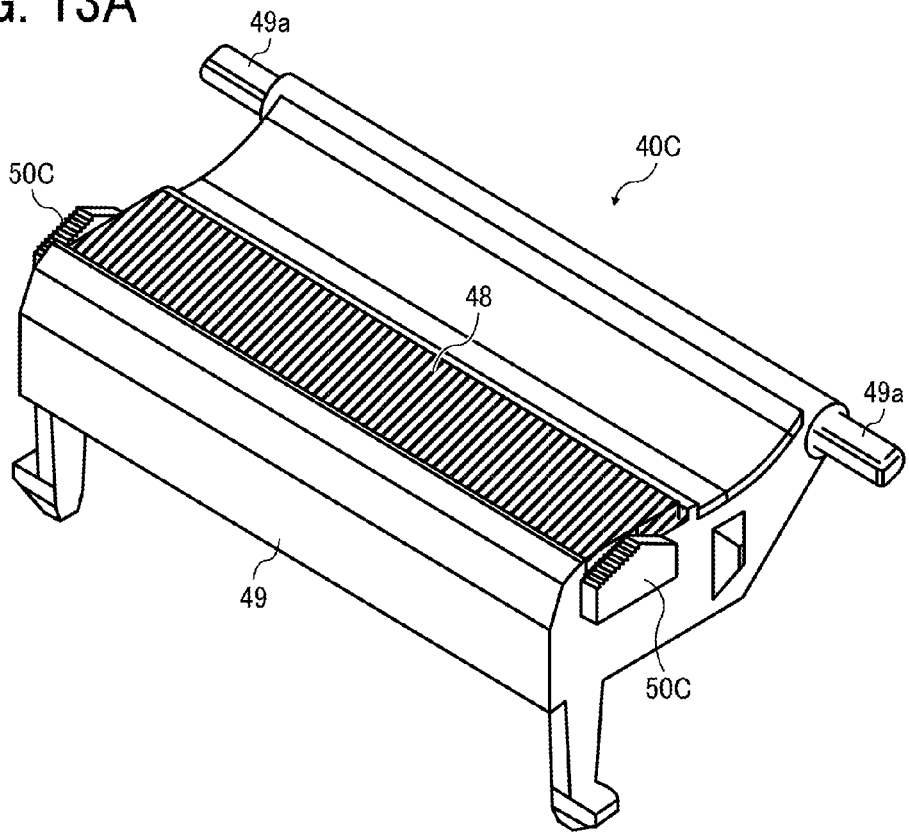
FIG. 13A is a perspective view illustrating a pad holder included in a sheet conveying device according to Embodiment 3.
Figure 13B:
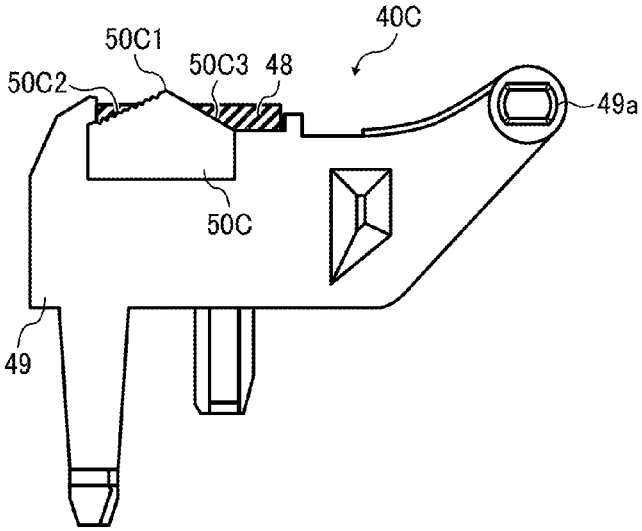
FIG. 13B is a side view illustrating the pad holder of the sheet conveying device according to Embodiment 3.

Next, a description is given of a sheet conveying device 40C according to Embodiment 3, with reference to FIGS. 13A and 13B.

The sheet conveying device 40C according to Embodiment 3 includes a pair of guides 50C as illustrated in FIGS. 13A and 13B. Each of the pair of guides 50C according to Embodiment 3 has a top portion 50C1, an upstream surface 50C2 disposed upstream from a top portion 50C1 of the pair of guides 50C, and a downstream upper surface 50C3. The upstream surface 50C2 has a sequentially uneven shape having a difference of elevation of 1 mm or less. The downstream upper surface 50C3 is disposed downstream from the top portion 50C1 to be a flat surface slanted as same as the upper surface 50A3 of Embodiment 1. The other features of the configuration of the sheet conveying device 40C are the same as the configuration of the sheet conveying device 40A of Embodiment 1.

Since the upstream surface 50C2 has the sequentially uneven shape, when a paper stack enters the surface of the pair of guides 50C, the leading edge of the paper stack collides the upstream surface 50C2 having the sequentially uneven shape to be flipped through in a cascade manner. Therefore, the sequentially uneven shape of the upstream surface 50C2 can enhance prevention of multiple feeding of paper in the sheet conveying device 40C. The difference of elevation of the upstream surface 50C2 having the sequentially uneven shape is preferably 1 mm or smaller. If the difference of elevation is greater than 1 mm, multiple papers of the paper stack collide the same convex/concave part, which degrades flipping of the papers in the cascade manner. However, if the difference of elevation is extremely small, the leading edge of the paper P cannot be held reliably. Therefore, the difference of elevation is preferably 0.1 mm or greater.

In FIGS. 13A and 13B, the sequentially uneven shape of the upstream surface 50C2 is a triangular shape or an angled shape. However, the sequentially uneven shape can be an arc shape, a rectangular shape, and so forth. Further, the upstream surface 50C2 can have the sequentially uneven shape over the whole area of the upstream surface 50C2, on an upstream, middle, or downstream part, or intermittently from the upstream side to the downstream side with a flat portion interposed therebetween.

[Embodiment 4]

Figure 14A:
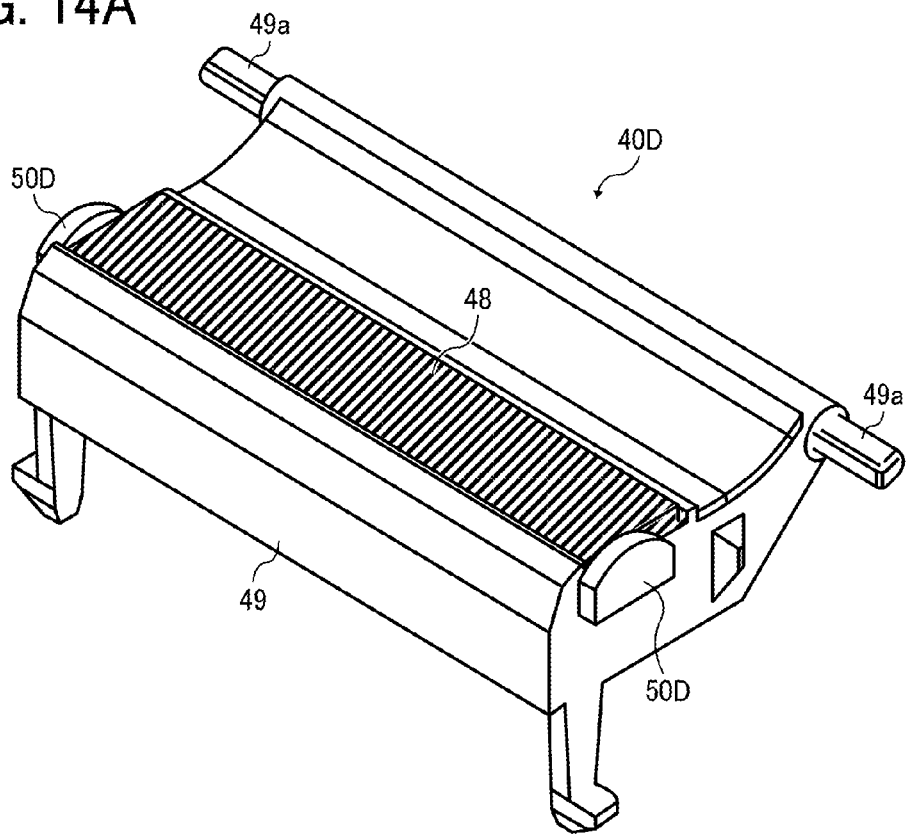
FIG. 14A is a perspective view illustrating a pad holder included in a sheet conveying device according to Embodiment 4.
Figure 14B:
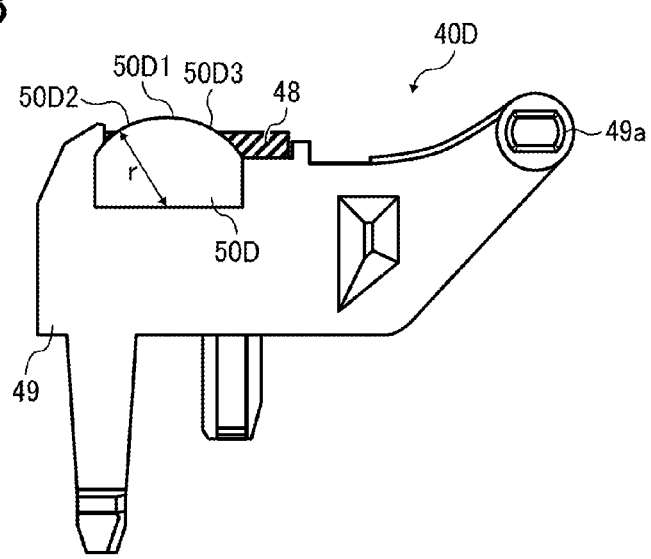
FIG. 14B is a side view illustrating the pad holder of the sheet conveying device according to Embodiment 4.

Next, a description is given of a sheet conveying device 40D according to Embodiment 4, with reference to FIGS. 14A and 14B.

As illustrated in FIGS. 14A and 14B, the sheet conveying device 40D according to Embodiment 4 includes a pair of guides 50D. Each of the pair of guides 50D has a top portion 50D1, an upstream top surface 50D2, and a downstream surface 50D3. The upstream surface 50D2 disposed upstream from the top portion 50D1 and the downstream surface 50D3 disposed downstream from the top portion 50D1 are connected by an arc having a common radius "r". With this configuration, the angle of approach for the leading edge of the paper P to come over the surface of the pair of guides 50D becomes gentle, thereby preventing non-feeding due to an exceed of conveying load.

Further, the trailing edge of the paper P can prevent collision thereof to a subsequent paper when the paper P leaves from the pair of guides 50D, thereby enhancing quietness by preventing collision of the friction pad 48 to the surface on the downstream side thereof.

Further, since the upstream top surface 50D2 and the downstream top surface 50D3 of the pair of guides 50D are connected by the continuous common arc, the parts can be manufactured easily, thereby contributing to a low-cost, high-quality sheet conveying device 40D.

[Embodiment 5]

Figure 15A:
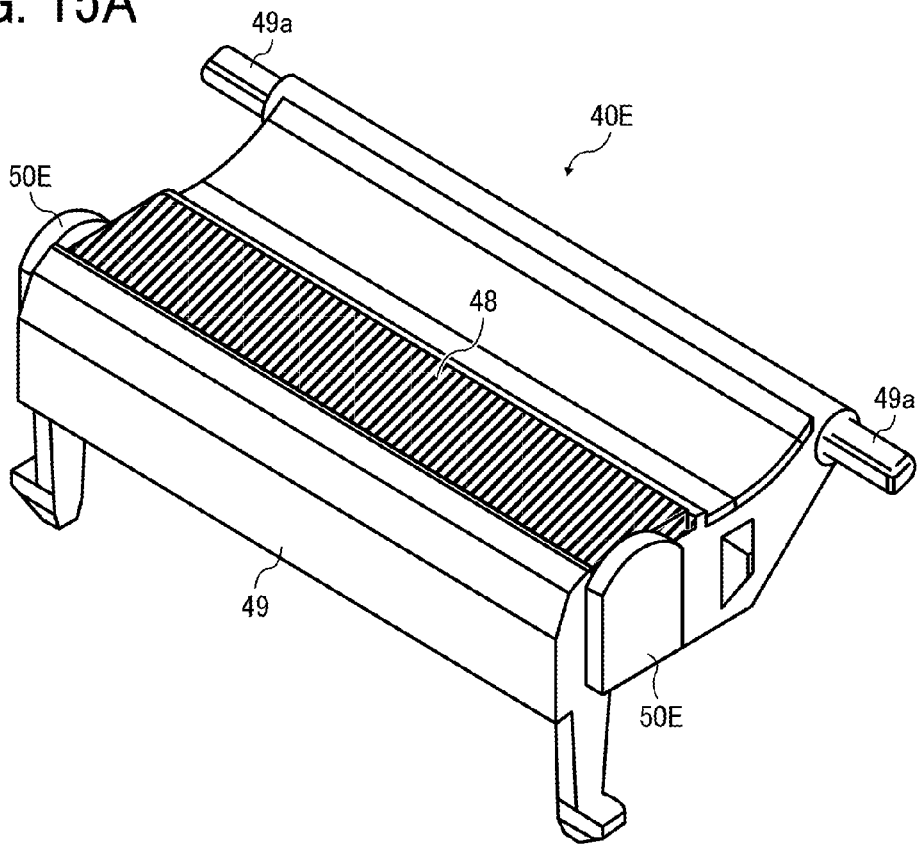
FIG. 15A is a perspective view illustrating a pad holder included in a sheet conveying device according to Embodiment 5.
Figure 15B:
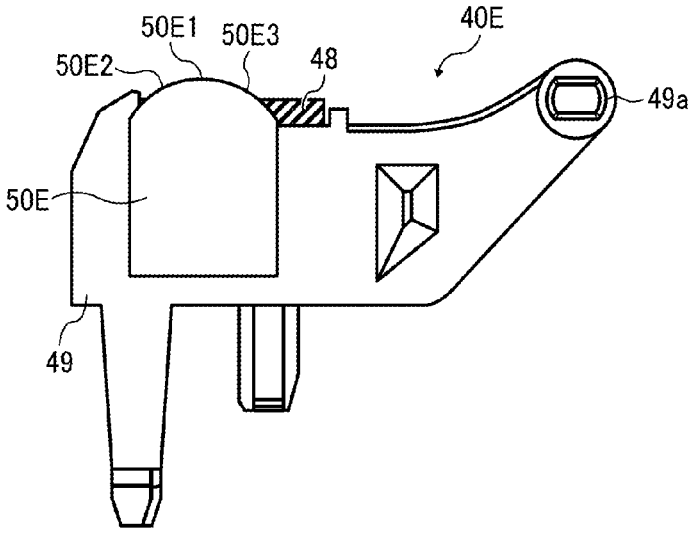
FIG. 15B is a side view illustrating the pad holder of the sheet conveying device according to Embodiment 5.
Figure 15C:
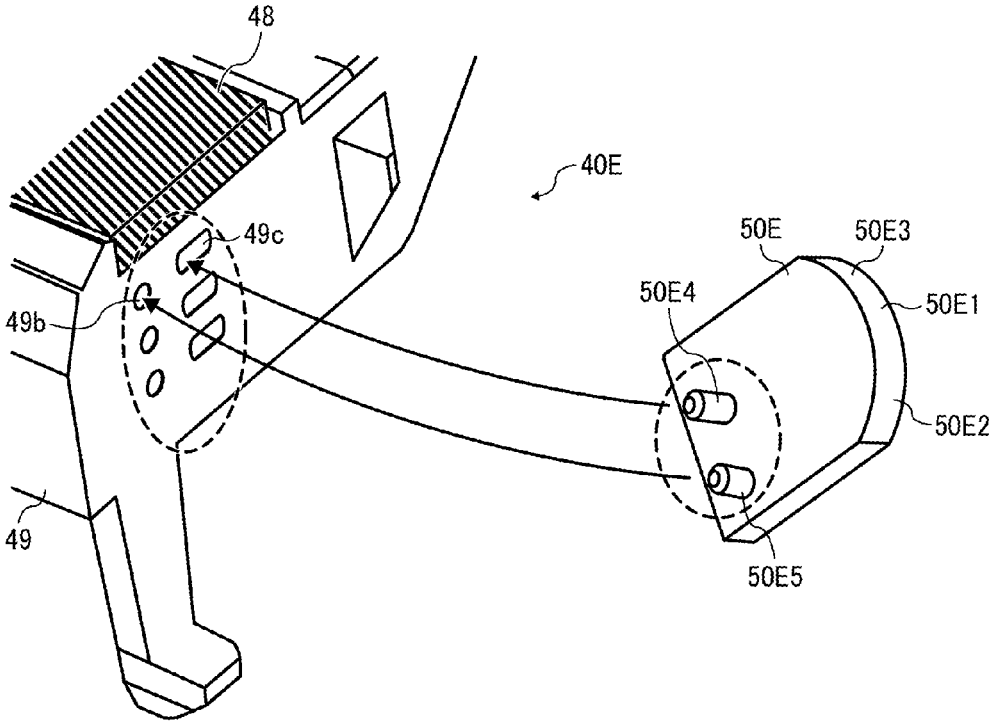
FIG. 15C is an exploded perspective view illustrating the pad holder of the sheet conveying device according to Embodiment 5.

Next, a description is given of a sheet conveying device 40E according to Embodiment 5, with reference to FIGS. 15A through 15C.

As illustrated in FIGS. 15A and 15B, the sheet conveying device 40E according to Embodiment 5 includes a pair of guides 50E. Each of the pair of guides 50E has a top portion 50E1, an upstream surface 50E2, and a downstream surface 50E3. The shape of the upper surface of the pair of guides 50E is the same as those of the pair of guides 50D of Embodiment 4, except that the pair of guides 50E is formed separate from the pad holder 49.

A pair of short engaging shafts 50E4 and 50E5 is formed vertically to an inner surface of the lower portion of the pair of guides 50E. With respect to the pair of engaging shafts 50E4 and 50E5, three sets of a round opening 49*b* and a slot 49*c* are formed at equal intervals vertically to function as selectable engaging portions for the pair of engaging shafts 50E4 and 50E5. By selecting a set of the round opening 49*b* and the slot 49*c* and engaging the pair of engaging shafts 50E4 and 50E5 therewith, the pair of guides 50E can be detachably attached to the pad holder 49 and change the position of attachment of the pair of engaging shafts 50E4 and 50E5. The number of the round opening 49*b* and the slot 49*c* are not limited to three and can be more than or less than three sets. Further, the interval in the vertical direction of the groups of the round opening 49*b* and the slot 49*c* may not be equal.

Since the pair of guides 50E are formed separate from the pad holder 49, replacement and/or maintenance of the pair of guides 50E can be facilitated and selection of optional material for the guide 50E can set an optimal friction coefficient on the upper surface of the pair of guides 50E without the limitation of the friction coefficient due to material of the pad holder 49. For example, if the friction coefficient of the pair of guides 50E is set smaller than the friction coefficient of the friction pad 48, abrasion of the pair of guides 50E due to friction thereof with a paper can be decreases and the conveying load of the paper can be reduced, thereby preventing non-feeding due to an exceed of conveying load.

Further, by setting the friction coefficient of the pair of guides 50E greater than the friction coefficient of the friction pad 48, not only the friction pad 48 but also the pair of guides 50E can flip through the papers, thereby enhancing prevention of multiple feeding of the papers that are intended to be fed in a paper stack. Thus, the pair of guides 50E is formed separate from the pad holder 49 to contribute to a low-cost, high-quality sheet conveying device 40E with good durability.

Further, by selecting the positions of the round opening 49*b* and the slot 49*c*, the installation height of the pair of guides 50E can be changed. As a result, use of common parts among apparatuses having different heights of the pair of guides 50E and an increase in lift by changing the installation positions of the pair of worn guides 50E can be enhanced.

[Embodiment 6]

Figure 16A:
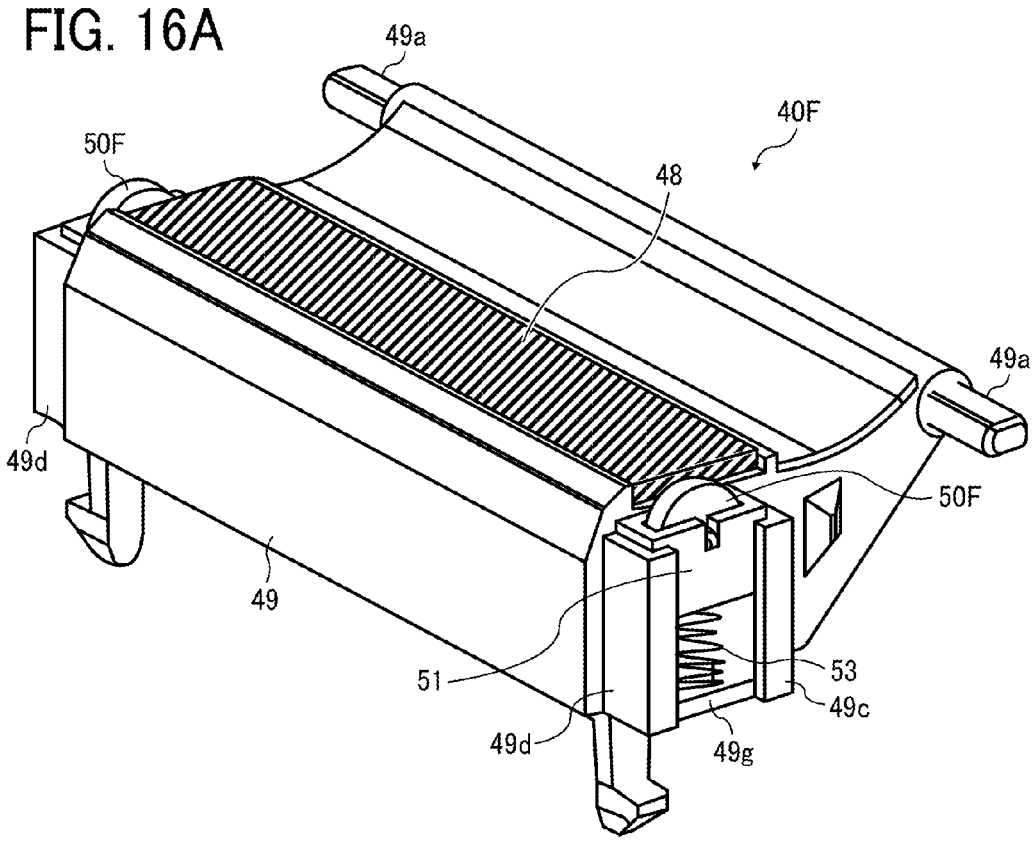
FIG. 16A is a perspective view illustrating a pad holder included in a sheet conveying device according to Embodiment 6.
Figure 16B:
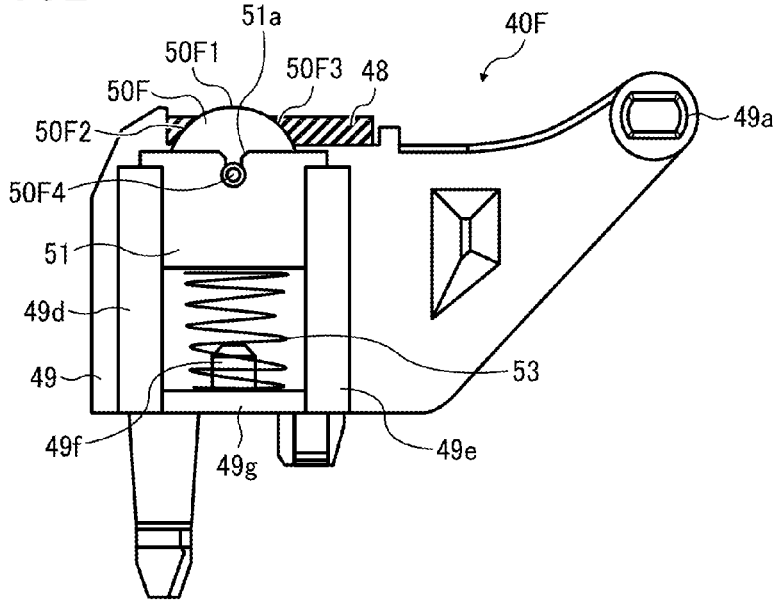
FIG. 16B is a side view illustrating the pad holder of the sheet conveying device according to Embodiment 6.
Figure 16C:
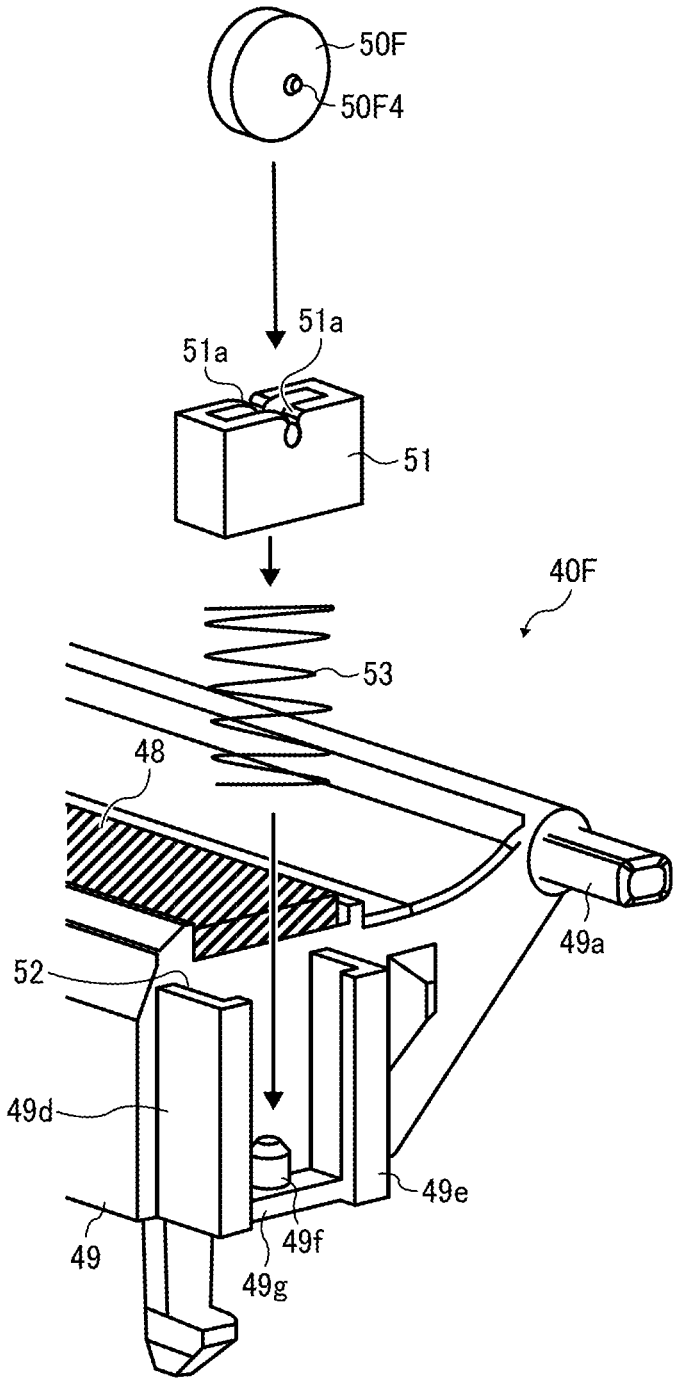
FIG. 16C is an exploded perspective view illustrating the pad holder of the sheet conveying device according to Embodiment 6.
Figure 17:
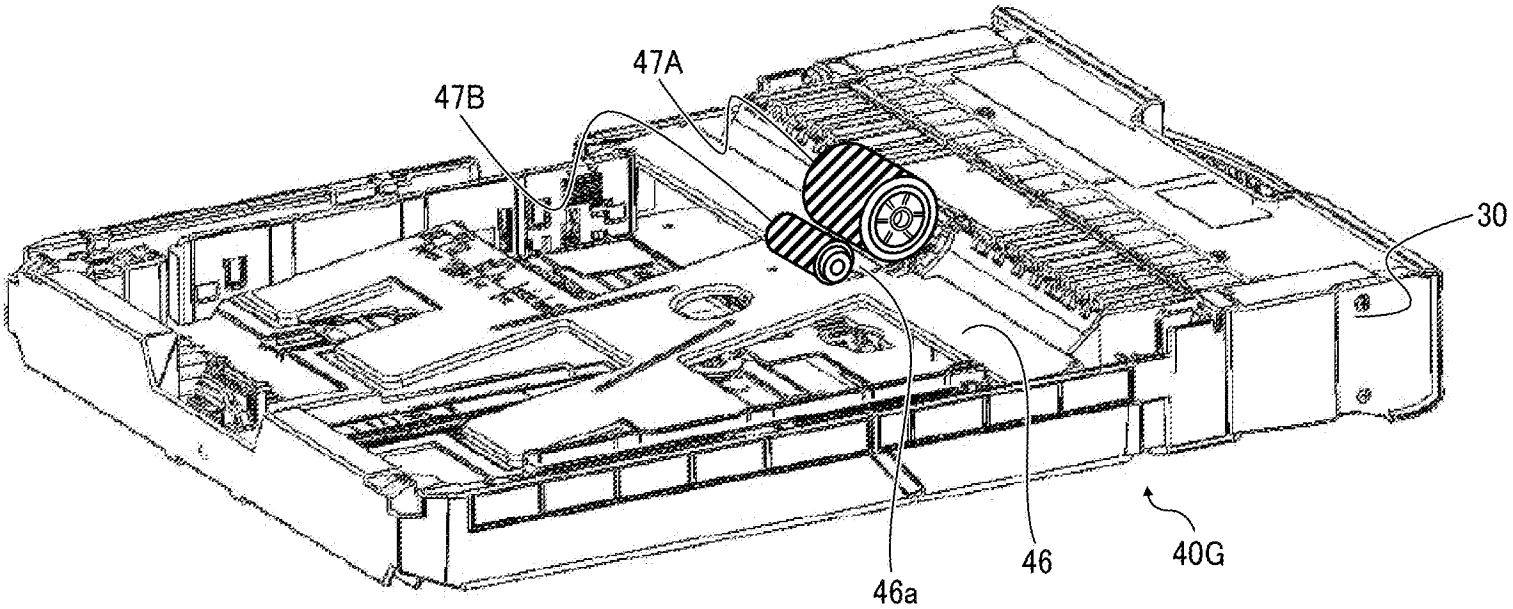
FIG. 17 is a perspective view illustrating a sheet tray including a sheet conveying device according to Embodiment 7.
Figure 18:
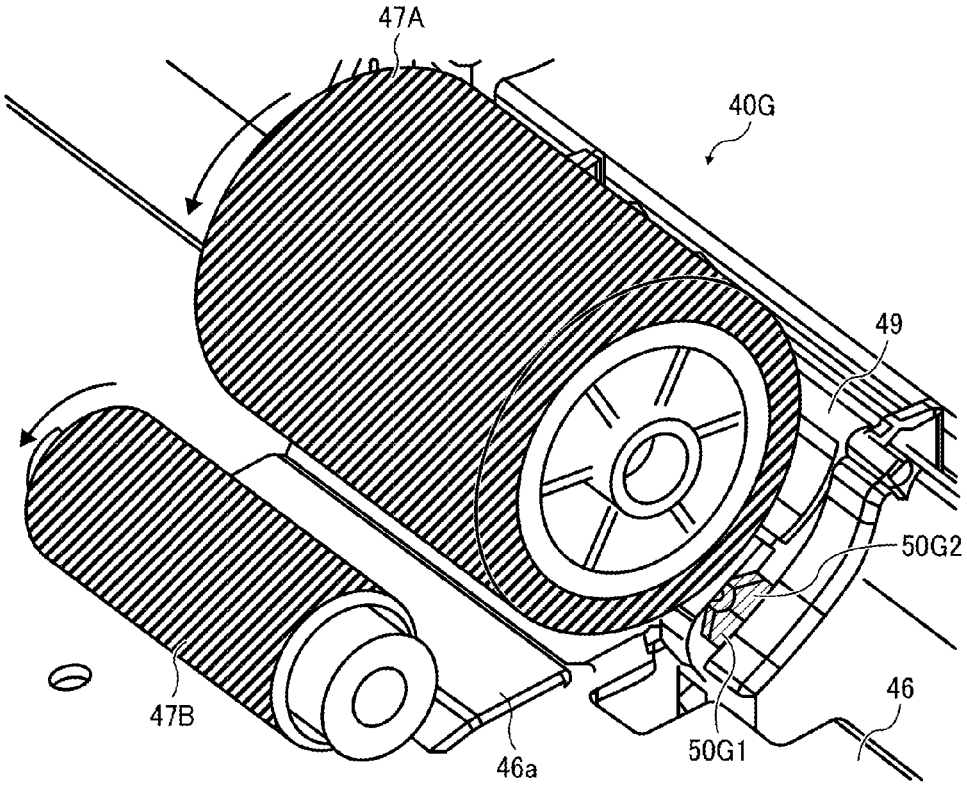
FIG. 18 is an enlarged perspective view illustrating the sheet conveying device according to Embodiment 7.
Figure 19:
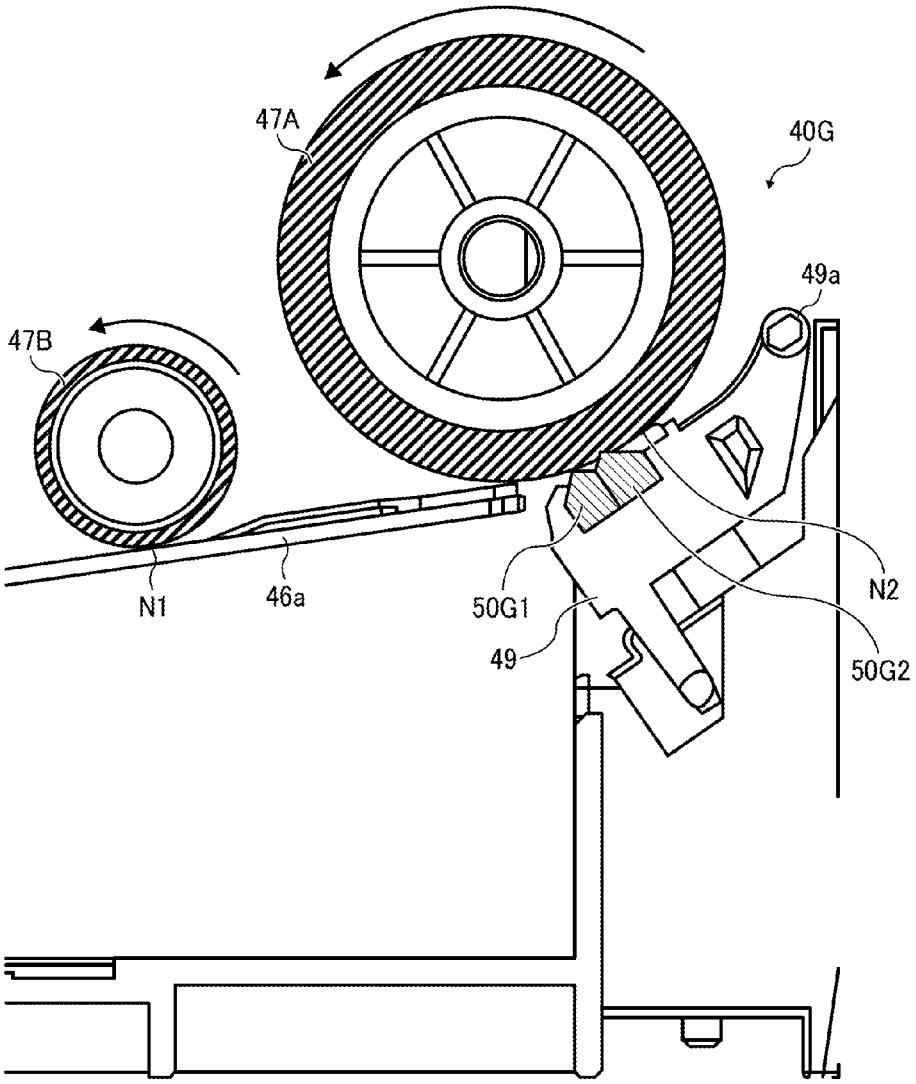
FIG. 19 is a side view illustrating the sheet conveying device according to Embodiment 7.

Next, a description is given of a sheet conveying device 40F according to Embodiment 6, with reference to FIGS. 16A through 16C.

As illustrated in FIGS. 16A and 16B, the sheet conveying device 40F according to Embodiment 6 includes a pair of guides 50F. Each of the pair of guides 50F has a top portion 50F1, an upstream surface 50F2, and a downstream surface 50F3. The shape of the upper surface of the pair of guides 50F is the same as those of the pair of guides 50D of Embodiment 4, except that the pair of guides 50F are formed separate from the pad holder 49 and have a cylindrical body or a disk body. A pair of supporting shafts 50F4 formed at the center on both sides of the pair of guides 50F is rotatably engaged with a groove 51*a* of a rectangular receiving member 51. The lower half of the pair of guides 50F is accommodated in the receiving member 51 and the upper half of the pair of guides 50F is projected from the receiving member 51.

A pair of supporting members 49*d* and 49*e* having an L-shaped cross section is integrally formed vertically on both sides of the pad holder 49, and a vertical groove 52 that can accommodate the receiving member 51 between the pair of supporting members 49*d* and 49*e*. The receiving member 51 is inserted into the vertical groove 52 with the receiving member 51 being vertically movable. A bottom 49*g* with a positioning shaft 49*f* attached at the bottom of the vertical groove 52 is formed and a coil spring 53 is disposed vertically between the bottom 49*g* and the receiving member 51. The lower part of the spring 53 is positioned by fitting with an outer surface of the positioning shaft 49*f*.

Accordingly, the receiving member 51 is supported by the spring 53 to be vertically movable and the pair of guides 50F is rotatable and vertically movable. The receiving member 51 is configured to contact a non-illustrated height regulating unit formed on the pad holder 49 with the spring 53 vertically pressed to some extent, and therefore cannot elevate higher. As illustrated in FIG. 16B, the top portion 50F1*a* of the pair of guides 50F projects upwardly from the upper surface of the friction pad 48 with the height of the receiving member 51 being limited.

Since the pair of guides 50F can rotate, when the paper P that comes over the pair of guides 50F slidably contacts the top portion 50F1 of the pair of guides 50F and the portions in the vicinity of the top portion 50F1 thereof, the pair of guides 50F rotate clockwise about the supporting shaft 50F4, as illustrated in FIG. 16B. Consequently, the conveyance resistance is reduced, together with abrasion of the pair of guides 50F due to friction with the paper, thereby increasing durability.

Further, since the upper surfaces 50F2 and 50F3 disposed interposing the top portion 50F1 of the pair of guides 50F are arc-shaped, the angle of approach becomes gentle when the leading edge of the paper P comes over the pair of guides 50F, which is same as the sheet conveying device 40D according to Embodiment 4, thereby preventing non-feeding due to an exceeded conveying load.

Further, the trailing edge of the paper P can prevent collision thereof to a subsequent paper when the paper P leaves from the pair of guides 50F, thereby enhancing quietness by preventing collision of the friction pad 48 to the surface on the downstream side thereof.

Further, since the sheet conveying device 40F has the spring 53 functioning a biasing member, a biasing force of each of the pair of guides 50F can be set, and therefore, separate from the separation nip pressure exerted between the sheet conveying roller 47 and the friction pad 48, a contact pressure between the papers can be adjusted by the biasing force of the pair of guides 50F. Thus, by controlling the contact pressure individually, abnormal noise caused by paper(s), multiple feeding, and non-feeding can be reduced.

[Embodiment 7]

Next, a description is given of a sheet conveying device 40G according to Embodiment 7, with reference to FIGS. 17 through 20B.

The sheet conveying device 40G according to Embodiment 7 includes two pairs of guides 50G1 and 50G2 aligned side by side in the sheet conveying direction. The number of pairs of guides 50G1 and 50G2 may be two or more. Beside the sheet conveying roller 47A that forms the separation nip area N2 with the friction pad 48, a second sheet conveying roller 47B is disposed above the front end portion 46*a* of the bottom plate 46. The second sheet conveying roller 47B functions as a second rotary conveyance member to pick up the paper P. The second sheet conveying roller 47B forms the conveyance nip area N1 with the front end portion 46*a* of the bottom plate 46. Due to a linking mechanism of the sheet conveying roller 47A disposed at the downstream side, a non-illustrated belt, and so forth, the sheet conveying rollers 47A and 47B are linked to rotate in the same direction.

By providing a clutch to the sheet conveying roller 47B disposed at the upstream side, the link with the sheet conveying roller 47A disposed at the downstream side can be shut if desired. The sheet conveying roller 47B contacts the front portion of an uppermost paper of the paper stack placed on the bottom plate 46. The sheet conveying roller 47B rotates counterclockwise in FIG. 19, so as to convey the uppermost paper toward a portion between the friction pad 48 and the separation nip area N2.

Figure 20A:
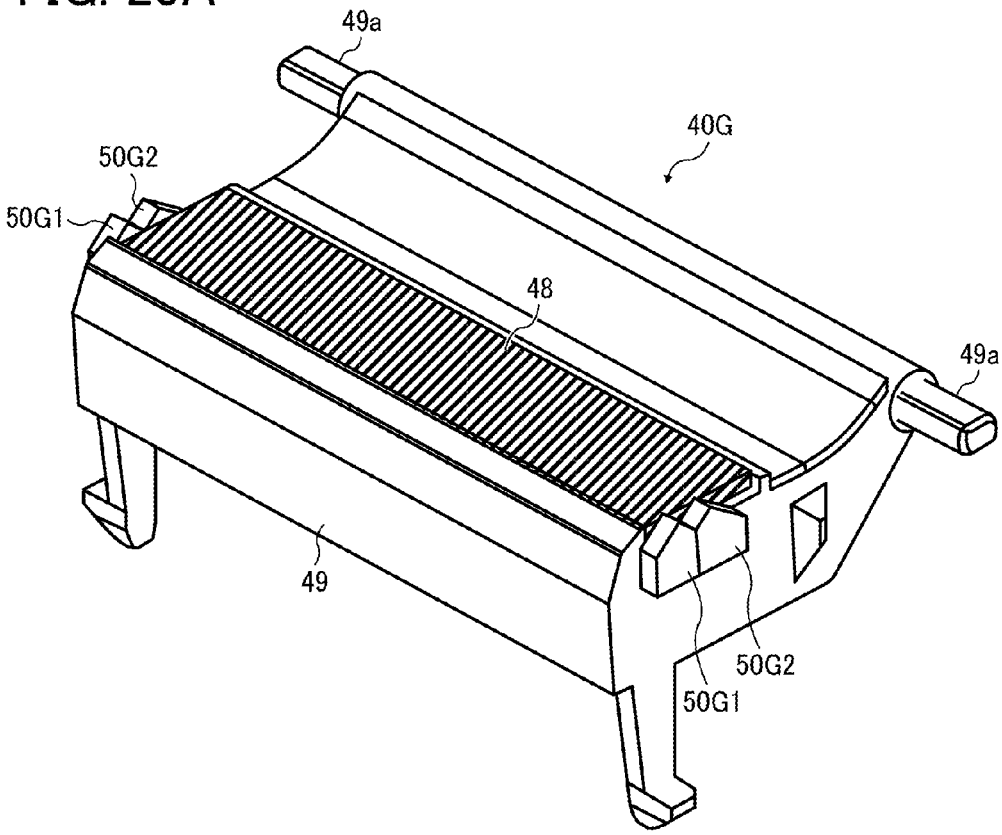
FIG. 20A is a perspective view illustrating a pad holder included in a sheet conveying device according to Embodiment 7.
Figure 20B:
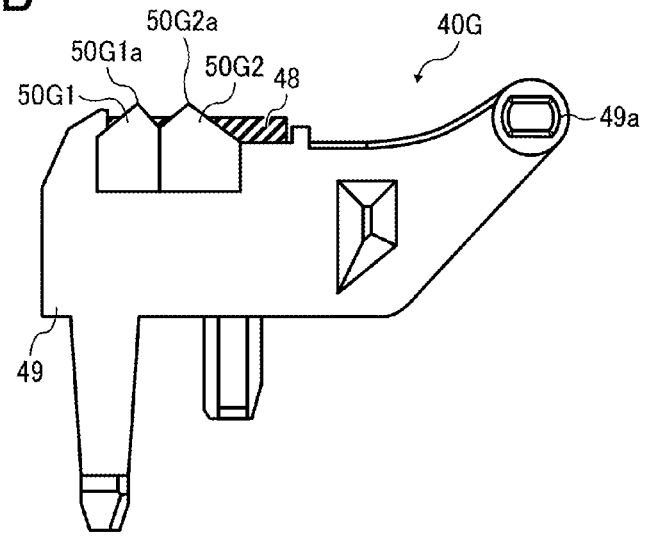
FIG. 20B is a side view illustrating the pad holder of the sheet conveying device according to Embodiment 7.

The pairs of guides 50G1 and 50G2 are a plate having a substantially pentagonal shape. The pairs of guides 50G1 and 50G2 have respective top portions 50G1*a* and 50G2*a* at the center thereof, which is the same as Embodiment 1. Respective angles of the top portions 50G1*a* and 50G2*a* can be set optionally to be an obtuse angle or an acute angle. As illustrated in FIG. 20B, the top portions 50G1*a* and 50G2*a* project upwardly from the upper surface of the friction pad 48 (toward the sheet conveying roller 47A). Respective amounts of projections of the pairs of guides 50G1 and 50G2 can be identical to each other or different from each other. As illustrated in FIGS. 17 through 20B, the pairs of guides 50G1 and 50G2 can be formed integrally to the pad holder 49. Alternatively, the pairs of guides 50G1 and 50G2 can be formed separate from the pad holder 49 as a different part, so as to be detachably attachable to both sides of the pad holder 49 via respective attaching portions such as pins or openings formed using a convex/concave engagement structure.

As described above, the sheet conveying device 40G according to Embodiment 7 includes the two pairs of guides 50G1 and 50G2 provided at both lateral ends. Compared with the above-described Embodiment 1 through Embodiment 6, the number of paper holding points arranged upstream from the separation nip area N2 doubles, thereby retaining the paper P more reliably. Consequently, vibration caused by stick-slip of the paper can be prevented effectively and the sheet conveyance action and accuracy are stabilized more reliably. As a result, generation of abnormal sound due to prevention of the vibration can be prevented reliably.

Further, the sheet conveying roller 47B is provided for picking up the paper P, and therefore a pickup conveying force of the paper P by the sheet conveying roller 47B and a separation conveying force of the paper P by the sheet conveying roller 47A can be set to their optimized values, thereby preventing multiple feeding and non-feeding of the paper P more reliably.

[Embodiment 8]

Figure 21:
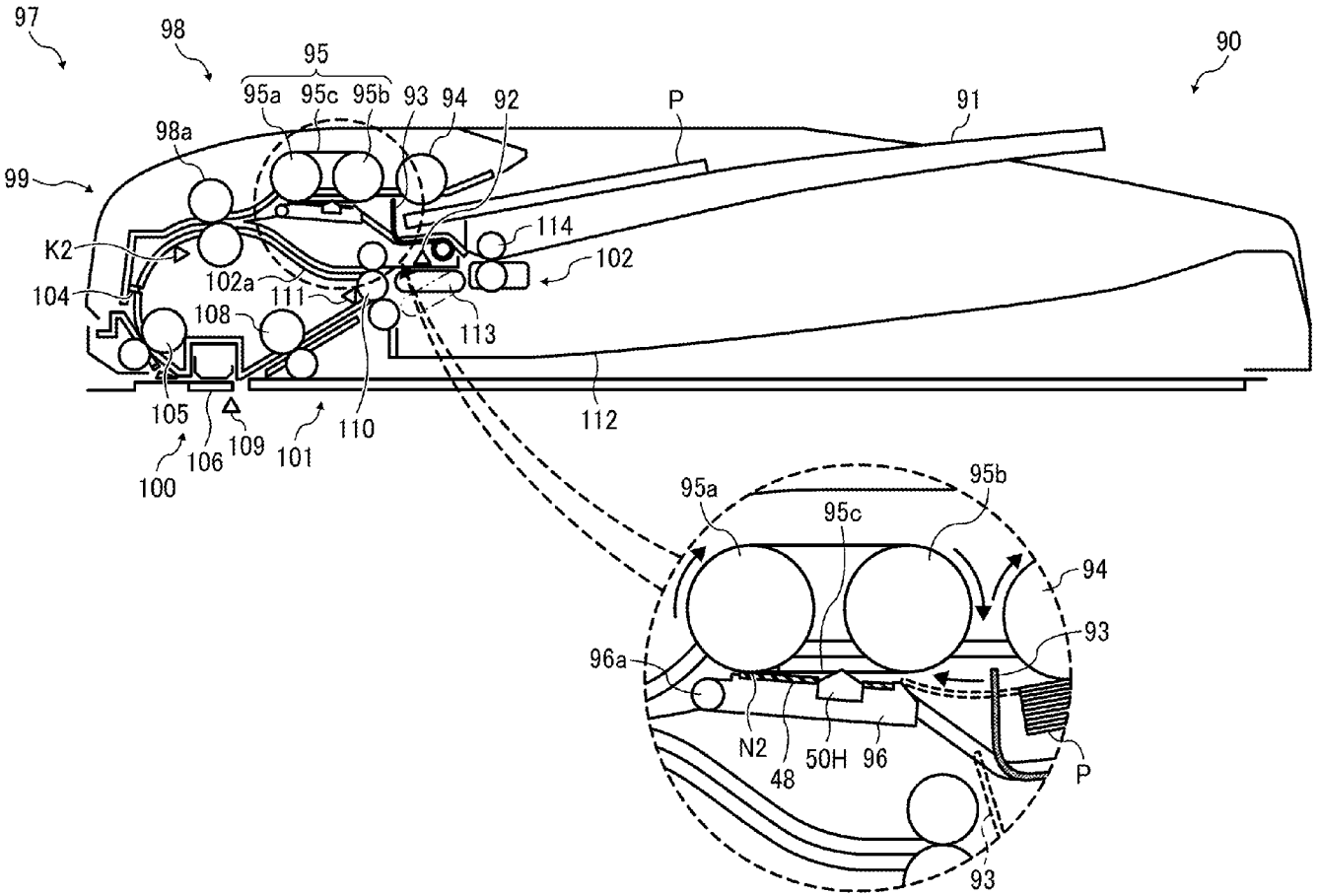
FIG. 21 is a cross-sectional view illustrating an automatic sheet conveying device according to Embodiment 8.

Next, a description is given of a sheet conveying device 95 according to Embodiment 6, with reference to FIG. 21.

The sheet conveying device 95 according to Embodiment 6 can be used to feed papers to an image forming apparatus or to an image reader. The sheet conveying device 40F used for the image reader can provide the same effect in sheet feeding as the image forming apparatus 1000.

Embodiment 8 describes the sheet conveying device 95 functioning as a sheet conveying device in an automatic document feeder (ADF) 90 for an image reader.

As illustrated in FIG. 21, the ADF 90 includes a sheet tray 91 on which the paper stack including the paper P is placed with a document side thereof facing up. In the vicinity of the leading edge of the sheet tray 91 in a document feeding direction, a non-illustrated set feeler that rotates when the paper P is placed on the sheet tray 91 is disposed. At a lowest portion on a rotation track of the leading edge of the set feeler, a paper setting sensor 92 is disposed to detect that the paper P is placed on the sheet tray 91. Namely, when the paper P is set on the sheet tray 91, the set feeler rotates to cause the leading edge thereof to become out of a sensor range of the set sensor, so that the paper setting sensor 92 detects that the paper P is placed on the sheet tray 91.

A stopper claw 93 is disposed downstream from the sheet tray 91 in the document feeding direction. The stopper claw 93 is driven by a non-illustrated sheet feeding solenoid to move vertically between a sheet abutting position (drawn with a solid line) against which the leading edge of the paper P abuts and a sheet retreating position (drawn with a dotted line) from which the leading edge of the paper P retreats downward.

When the stopper claw 93 is at the sheet abutting position, the leading edge of the paper P abuts against the stopper claw 93, thereby aligning the leading edge of the paper P. Both lateral sides of the paper P also abut against non-illustrated respective side fences mounted on the sheet tray 91, thereby positioning the paper Pin a direction perpendicular to the document feeding direction.

A conveying portion 97 of the ADF 90 includes a pickup roller 94, a sheet conveying device 95, a pullout portion 98, a turning portion 99, an image reading/conveying unit 100, a sheet discharging portion 101, and a switchback unit 102.

The pickup roller 94 moves vertically between a retreating position to retreat from the paper P by a non-illustrated document feeding solenoid and a contact position to contact an upper surface of the paper P.

The sheet conveying device 95 includes a pair of sheet conveying rollers 95*a* and 95*b*, a conveying belt 95*c*, and a pad holder 96. The conveying belt 95*c* is stretched around the pair of sheet conveying rollers 95*a* and 95*b*. The pad holder 96 is below the conveying belt 95*c* with a sheet conveying path formed therebetween. The pad holder 96 includes a supporting pin 96*a* disposed at a downstream side thereof, so that an upstream end side thereof is movable vertically about the supporting pin 96*a*. The friction pad 48 is provided on an upper surface of the pad holder 96. A lower surface of the conveying belt 95*c* contacts the friction pad 48 to form a separation nip area N2 therebetween. A pair of guides 50H is disposed outside both lateral end sides of the pad holder 96. The pair of guides 50H has a shape substantially similar to the pair of guides 50A of FIG. 7B.

The conveying belt 95*c* rotates in the document feeding direction (i.e., a clockwise direction) and slidably contacts the friction pad 48 of the pad holder 96. When multiple feeding occurs to the papers P, a frictional resistance of the friction pad 48 prevents feed of a sequential paper.

In the sheet conveying device 95, with the stopper claw 93 at the sheet retreating position, the rotating pickup roller 94 contacts an uppermost paper of the paper stack including the papers P on the sheet tray 91 and picks up the uppermost paper to convey to the downstream side. If the multiple feeding of the papers P occurs, the second and subsequent papers are separated one by one by the conveying belt 95*c* and the friction pad 48 to be fed one by one.

The pullout portion 98 includes a pair of grip rollers 98*a* and a sheet detector K2. The pair of grip rollers 98*a* functioning as a pair of rollers disposed sandwiching the conveying path. The sheet detector K2 is disposed downstream from the pair of grip rollers 98*a*.

The pullout portion 98 primarily aligns the papers P fed at a drive timing of the pair of grip rollers 98*a* and the pickup roller 94 to convey the aligned papers to the downstream side in the document feeding direction. The sheet detector K2 detects the leading edge of the paper P conveyed from the sheet conveying device 95.

The turning portion 99 is formed by a downwardly curved conveying path and includes a timing sensor 104 and a pair of image reader entrance rollers 105. The turning portion 99 turns the paper P from the pullout portion 98 by conveying the paper P in the curved conveying path, and the pair of image reader entrance rollers 105 causes the paper P to face down to convey the paper P to a slit glass 106. Further, the timing sensor 104 detects the leading and trailing edges of the paper P conveyed from the pullout portion 98 to the image reading/conveying unit 100.

The image reading/conveying unit 100 includes an image reader guide and a pair of image reader exit rollers 108. The image reader is disposed facing the slit glass 106 with the conveying path therebetween. The pair of image reader exit rollers 108 is disposed to interpose the conveying path at which the paper P is conveyed after the paper P is read.

The image reading/conveying unit 100 conveys a document paper with the surface thereof contacting the slit glass 106 while the image reader guide guides the paper conveyed in the vicinity of the slit glass 106, reads an image of the document paper by a non-illustrated optical part of a scanner at the image reading position 109, and further conveys the read document paper by the pair of image reader exit rollers 108. The pair of image reader exit rollers 108 conveys the read paper P further downstream in the document feeding direction.

The sheet discharging portion 101 includes a pair of sheet discharging rollers 110 and a sheet discharging sensor 111. The pair of sheet discharging rollers 110 is disposed in the vicinity of a sheet exit.

The pair of sheet discharging rollers 110 discharges the paper P after conveyed by the pair of image reader exit rollers 108 to the sheet discharging tray 112. The sheet discharging sensor 111 detects the trailing edge of the paper P to be discharged from the sheet exit to the sheet discharging tray 112.

The switchback unit 102 includes a separation claw 113 disposed near the sheet exit and a pair of reverse rollers 114. The separation claw 113 is driven by a non-illustrated sheet switchback solenoid to move vertically between a first switching position (drawn with a dotted line) at which the paper P conveyed from the pair of sheet discharging rollers 110 is conveyed to a conveying path that leads the paper P to the pair of reverse rollers 114 and a second switching position (drawn with a solid line) at which the paper P reversed by the pair of reverse rollers 114 is conveyed to a switchback path 102*a* that leads the paper P to the pair of grip rollers 98*a*. Further, the pair of reverse rollers 114 reverses and conveys the paper P that is switched back for duplex reading of the paper P to the switchback path 102*a*.

Therefore, the switchback unit 102 causes the paper P for duplex reading to be switched back and conveyed to the pair of grip rollers 98*a* via the separation claw 113, the pair of reverse rollers 114, and the switchback path 102*a*.

The sheet conveying device 95 for the image reader has the above-described configuration. According to the sheet conveying device 95, similar to the sheet conveying device 40 used in the above-described image forming apparatus 1000, as the pair of guides 50H lifts up the paper P, the retaining state of the paper P becomes more stable, thereby no longer setting a high friction force between the friction pad and the paper P. Accordingly, an increase in vibration of stick-slip caused by an excess of the friction force and abnormal sound are prevented and a reduction in rubbing noise is enhanced, thereby achieving respective optimum pressure settings at the conveyance nip area and the separation nip area. As a result, a reliable image reader with more quietness and no misfeeding such as multiple feeding or non-feeding can be achieved.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet conveying device comprising:

a holder;

a friction member held by the holder;

a rotary conveyance member having an outer circumferential surface which forms a nip area between the outer circumferential surface and the friction member, the rotary conveyance member configured to rotate while contacting the friction member, and separate and convey multiple sheet-like materials one by one at the nip area; and a pair of guides configured to lift an underside of each of the sheet-like materials at a portion facing the friction member, the pair of guides disposed upstream from the nip area in a sheet conveying direction, outside both ends in an axial direction of the rotary conveyance member, separate from the nip area from the axial direction of the rotary conveyance member, wherein the pair of guides includes a top portion that is between the nip area and an upstream end of the friction member in the sheet conveying direction, the top portion of the pair of guides is formed as an upstream slope guide surface on an upstream side thereof in the sheet conveying direction, and as a downstream slope guide surface on a downstream side thereof in the sheet conveying direction, the upstream end of an upper surface of the friction member is located above an upstream end of the pair of guides in the axial direction of the rotary conveyance member, and wherein the pair of guides is configured to be continuously formed with the holder.

2. The sheet conveying device according to claim 1, wherein the top portion of the pair of guides is substantially even with the outer circumferential surface of the rotary conveyance member.

3. The sheet conveying device according to claim 2, wherein an angle formed by the upstream slope guide surface and an overside of the friction member from the nip area to an upstream end of the friction member in the sheet conveying direction is 45 degrees or smaller.

4. The sheet conveying device according to claim 2, wherein an angle formed by the downward slope guide surface and an overside of the friction member from the nip area to a downstream end of the friction member in the sheet conveying direction is 90 degrees or smaller.

5. The sheet conveying device according to claim 4, wherein at least one of the upstream slope guide surface and the downstream slope guide surface of the pair of guides has a tapered width gradually narrowed downwardly in the sheet conveying direction.

6. The sheet conveying device according to claim 4, wherein both the upstream slope guide surface and the downstream slope guide surface have a protruding curved shape.

7. The sheet conveying device according to claim 6, wherein the upstream slope guide surface and the downstream slope guide surface are connected including the top portion by a continuous curved shape having a common radius.

8. The sheet conveying device according to claim 2, wherein a ridgeline of the top portion of the pair of guides has an upwardly projecting arc shape on a side of the rotary conveyance member as viewed from the axial direction of the rotary conveyance member.

9. The sheet conveying device according to claim 2, wherein the top portion of the pair of guides has a ridgeline having an upwardly projecting arc shape on a side of the rotary conveyance member as viewed from the sheet conveying direction.

10. The sheet conveying device according to claim 1, wherein each of the pair of guides includes the upstream slope guide surface with a sequentially uneven shape having a difference of elevation of 1 mm or less.

11. The sheet conveying device according to claim 1, wherein the pair of guides is outside both lateral end sides of the friction member in a direction perpendicular to the sheet conveying direction.

12. The sheet conveying device according to claim 1, wherein the pair of guides is configured to be separate from the holder.

13. The sheet conveying device according to claim 12, wherein the holder comprises multiple sets of engaging portions configured to engage the pair of guides to the holder, wherein the position of the pair of guides is changed by selecting one of the multiple sets of engaging portions to which the pair of guides is attached.

14. The sheet conveying device according to claim 1, wherein a friction coefficient of the pair of guides is smaller than a friction coefficient of the friction member.

15. The sheet conveying device according to claim 1, wherein a friction coefficient of the pair of guides is greater than a friction coefficient of the friction member.

16. An image forming apparatus comprising:

the sheet conveying device according to claim 1;

an image forming device configured to form the image to be transferred onto each of the sheet-like materials fed by the sheet conveying device;

a discharging portion configured to receive the sheet-like materials discharged; and a sheet discharging unit configured to discharge the sheet-like materials with the image formed thereon to an outside of the image forming apparatus.

17. The sheet conveying device according to claim 1, wherein the pair of guides includes a conductive material.

18. The sheet conveying device according to claim 1, wherein the upstream end of the friction member is upstream from the top portion of pair of guides in the sheet conveying direction.

19. The sheet conveying device according to claim 1, wherein the upstream slope guide surface and the downstream slope guide portion have the same width.

20. The sheet conveying device according to claim 1, wherein the upstream end of the upper surface of the friction member is located at a position closer to the sheet conveying path than the pair of guides.

21. The sheet conveying device according to claim 1, wherein the friction member is a pad.

22. A sheet conveying device comprising:

a holder;

a friction member held by the holder;

a rotary conveyance member having an outer circumferential surface which forms a nip area between the outer circumferential surface and the friction member, the rotary conveyance member configured to rotate while contacting the friction member, and separate and convey multiple sheet-like materials one by one at the nip area; and a pair of guides configured to lift an underside of each of the sheet-like materials at a portion facing the friction member, the pair of guides disposed upstream from the nip area in a sheet conveying direction, outside both ends in an axial direction of the rotary conveyance member, separate from the nip area from the axial direction of the rotary conveyance member, wherein the pair of guides includes a top portion that is between the nip area and an upstream end of the friction member in the sheet conveying direction, the top portion of the pair of guides is formed as an upstream slope guide surface on an upstream side thereof in the sheet conveying direction, and as a downstream slope guide surface on a downstream side thereof in the sheet conveying direction, the upstream end of an upper surface of the friction member is located above an upstream end of the pair of guides in the axial direction of the rotary conveyance member, and wherein a friction coefficient of the pair of guides is greater than a friction coefficient of the friction member.

* * * * *